US008125411B2

(12) United States Patent
Lim et al.

(10) Patent No.: US 8,125,411 B2
(45) Date of Patent: Feb. 28, 2012

(54) PLASMA DISPLAY APPARATUS AND DRIVING METHOD THEREOF TO REDUCE AFTER-IMAGES

(75) Inventors: Hyun Jae Lim, Namyangjoo-si (KR); Muk Hee Kim, Buk-gu Daegu (KR); Yong Hyun Huh, Busan (KR); Yun Kwon Jung, Gumi-si (KR)

(73) Assignee: LG Electronics Inc., Seoul (KR)

( * ) Notice: Subject to any disclaimer, the term of this patent is extended or adjusted under 35 U.S.C. 154(b) by 665 days.

(21) Appl. No.: 11/624,256

(22) Filed: Jan. 18, 2007

(65) Prior Publication Data

US 2008/0012796 A1 Jan. 17, 2008

(30) Foreign Application Priority Data

Jul. 13, 2006 (KR) ..... 10-2006-0066037

(51) Int. Cl.
*G09G 3/28* (2006.01)

(52) U.S. Cl. ..... 345/60; 345/68

(58) Field of Classification Search ..... 345/60, 345/67, 68

See application file for complete search history.

(56) References Cited

U.S. PATENT DOCUMENTS

| | | | | |
|---|---|---|---|---|
| 6,133,903 | A * | 10/2000 | Lee et al. | 345/691 |
| 6,150,767 | A * | 11/2000 | Huang | 315/169.4 |
| 6,414,654 | B1 * | 7/2002 | Makino | 345/60 |
| 6,597,333 | B2 * | 7/2003 | Todoroki et al. | 345/63 |
| 7,023,406 | B1 * | 4/2006 | Nunomura et al. | 345/63 |
| 7,133,008 | B2 * | 11/2006 | Naganuma | 345/63 |
| 2003/0117346 | A1 | 6/2003 | Tae | |
| 2004/0135768 | A1 * | 7/2004 | Gu | 345/156 |
| 2004/0251845 | A1 * | 12/2004 | Choi | 315/169.3 |
| 2005/0068738 | A1 * | 3/2005 | Kim et al. | 361/704 |
| 2005/0140587 | A1 * | 6/2005 | Cho | 345/63 |
| 2005/0243027 | A1 * | 11/2005 | Chung et al. | 345/60 |
| 2006/0125728 | A1 * | 6/2006 | Moon | 345/68 |

FOREIGN PATENT DOCUMENTS

| | | | |
|---|---|---|---|
| EP | 0548051 | A2 | 6/1993 |
| EP | 1498869 | A2 | 1/2005 |
| JP | 9-305142 | A | 11/1997 |
| JP | 11-24630 | A | 1/1999 |
| JP | 2000-010522 | | 1/2000 |

(Continued)

OTHER PUBLICATIONS

Chinese Office Action dated Nov. 28, 2008 for Application No. 200710000240.1, 6 pages.

(Continued)

*Primary Examiner* — Chanh Nguyen
*Assistant Examiner* — Kwang-Su Yang
(74) *Attorney, Agent, or Firm* — Fish & Richardson P.C.

(57) ABSTRACT

A plasma display apparatus and a driving method thereof are disclosed. The plasma display apparatus includes a plasma display panel comprising a first electrode and a second electrode, and a driver for applying a plurality of sustain signals to the second electrode while applying two consecutive sustain signals to the first electrode in a sustain period. A method of driving a plasma display apparatus includes applying a first sustain signal to a first electrode in a sustain period, after applying the first sustain signal to the first electrode, applying a plurality of sustain signals to a second electrode, and after applying the plurality of sustain signals to the second electrode, applying a second sustain signal consecutive to the first sustain signal to the first electrode.

5 Claims, 18 Drawing Sheets

FOREIGN PATENT DOCUMENTS

| | | | |
|---|---|---|---|
| JP | 2001-134232 | A | 5/2001 |
| JP | 2001-135242 | A | 5/2001 |
| JP | 2005-346063 | A | 12/2005 |
| JP | 2006-048068 | A | 2/2006 |
| JP | 2006-113585 | A | 4/2006 |
| KR | 10-2005-0025805 | * | 3/2005 |
| KR | 1020050045346 | | 5/2005 |

OTHER PUBLICATIONS

European Search Report dated Jan. 12, 2011 for Application No. 07250125.7, 8 pages.

* cited by examiner (a)

(b)

(a)

(b)

(a)

(b)

(a)

(b)

PLASMA DISPLAY APPARATUS AND DRIVING METHOD THEREOF TO REDUCE AFTER-IMAGES

This Nonprovisional application claims priority under 35 U.S.C. §119(a) on Patent Application No. 10-2006-0066037 filed in Korea on Jul. 13, 2006 the entire contents of which are hereby incorporated by reference.

BACKGROUND

1. Field

This document relates to a display apparatus and, more particularly, to a plasma display apparatus and a driving method thereof.

2. Related Art

In general, a plasma display apparatus of a display apparatus has a plasma display panel and a driver for driving the plasma display panel.

The plasma display panel has phosphors formed within discharge cells partitioned by barrier ribs, and a plurality of electrodes.

The driver applies a driving signal to the discharge cells through the electrodes.

Discharge is generated within each discharge cell by means of the driving signal. When discharge is generated within the discharge cell by the driving signal, a discharge gas filled within the discharge cell generates vacuum ultraviolet rays. The vacuum ultraviolet rays emit the phosphors formed within the discharge cell, generating a visible ray.

An image is displayed on the screen of the plasma display panel by means of the visible ray. Meanwhile, the conventional plasma display apparatus is problematic in that an afterimage is generated when an image is implemented on the screen.

SUMMARY

An aspect of this document is to provide a plasma display apparatus and a driving method thereof, in which the occurrence of an afterimage can be decreased.

In one aspect of the present invention, a plasma display apparatus comprises a plasma display panel comprising a first electrode and a second electrode, and a driver for applying a plurality of sustain signals to the second electrode while applying two consecutive sustain signals to the first electrode in a sustain period.

In another aspect of the present invention, a method of driving a plasma display apparatus comprises applying a first sustain signal to a first electrode in a sustain period, after the first sustain signal is applied to the first electrode, applying a plurality of sustain signals to a second electrode, and after the plurality of sustain signals are applied to the second electrode, applying a second sustain signal consecutive to the first sustain signal to the first electrode.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION

Reference will now be made in detail embodiments of the invention examples of which are illustrated in the accompanying drawings.

Figure 1:
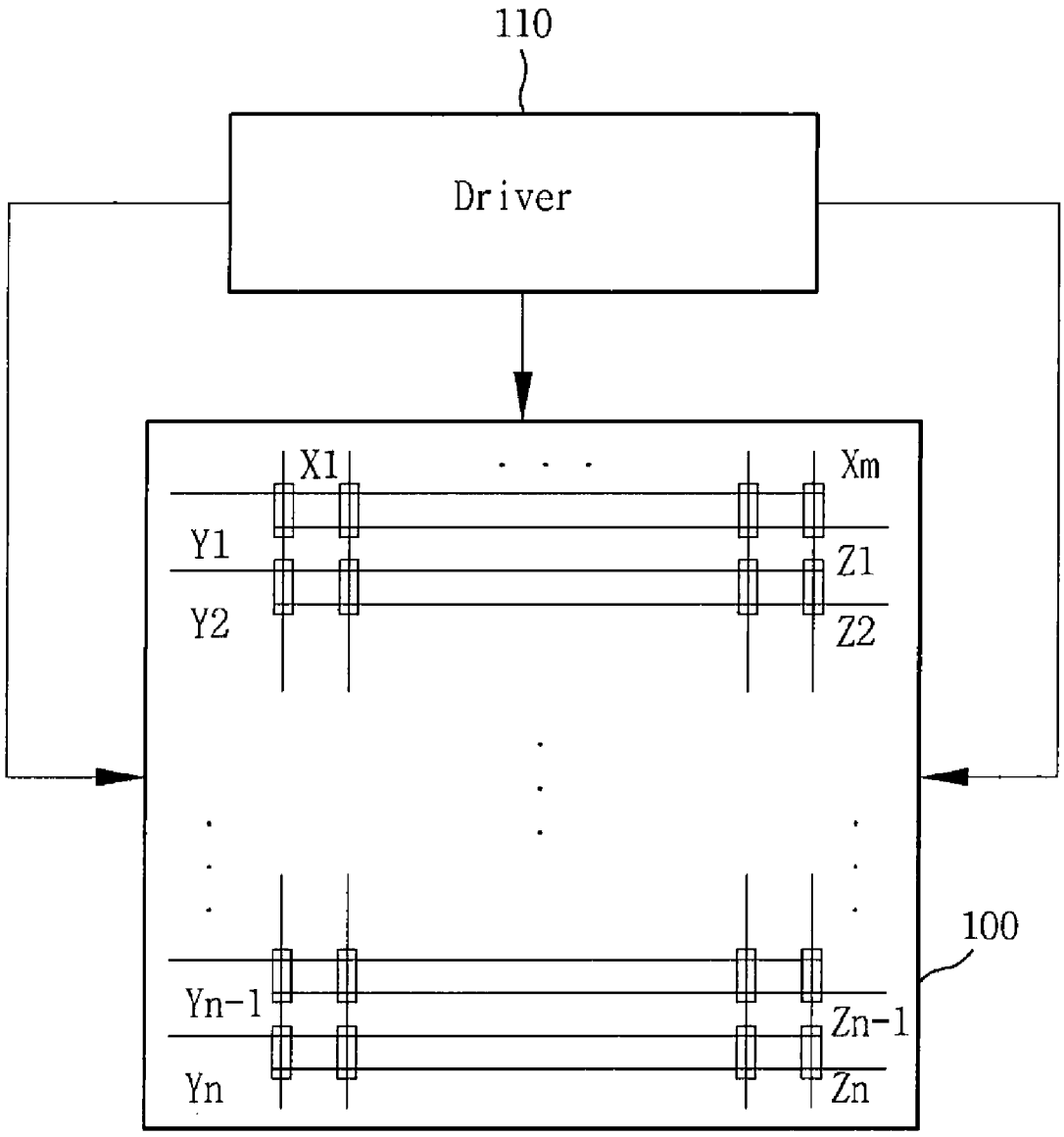
FIG. 1 is a view illustrating the construction of a plasma display apparatus according to an embodiment of the present invention.

FIG. 1 is a view illustrating the construction of a plasma display apparatus according to an embodiment of the present invention.

Referring to FIG. 1, a plasma display apparatus according to an embodiment of the present invention comprises a plasma display panel 100 and a driver 110.

The driver 110 applies a sustain signal to a first electrode and a second electrode of the plasma display panel 100 in a sustain period, and also applies a plurality of sustain signals to the second electrode while applying two consecutive sustain signals to the first electrode.

It has been shown in FIG. 1 that the driver 110 is formed in one board fashion. It is, however, to be noted that the driver 110 of the plasma display apparatus according to an embodiment of the present invention can be divided into a plurality of board forms depending on electrodes formed in the plasma display panel 100.

For example, in the case where a first electrode and a second electrode parallel to each other, and a third electrodes crossing the first electrode and the second electrode are formed in the plasma display panel 100 comprised in the plasma display apparatus according to an embodiment of the present invention, the driver 110 can be divided into a first driver (not shown) for driving the first electrode, a second driver (not shown) for driving the second electrode, and a third driver (not shown) for driving the third electrodes.

The driver 110 of the plasma display apparatus according to an embodiment of the present invention will become more evident from subsequent descriptions.

An example of the construction of the plasma display panel 100 is described below in detail with reference to FIGS. 2*a* and 2*b*.

Figure 2A:
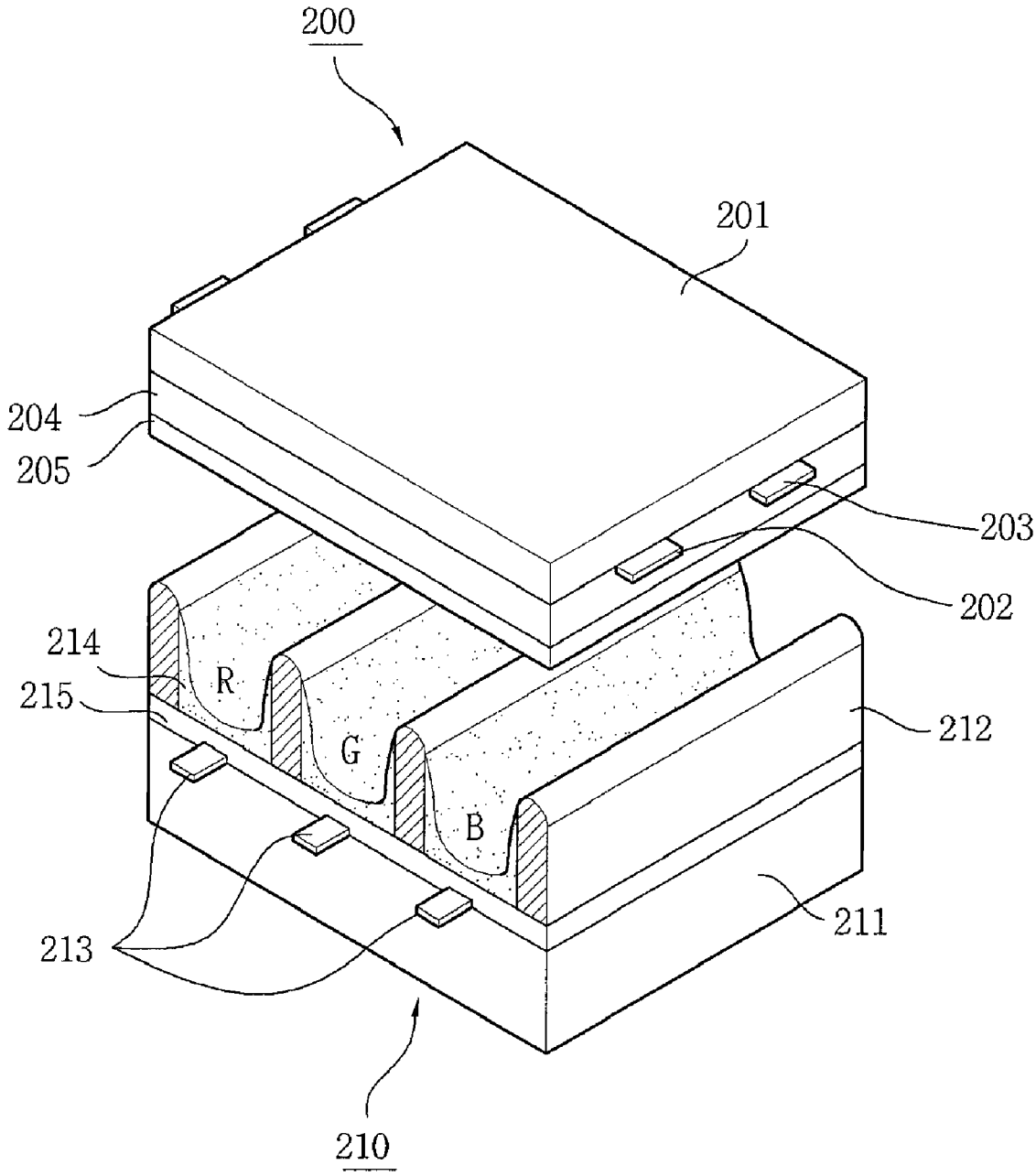
FIGS. 2*a* and 2*b* are views illustrating the construction of a plasma display panel comprised in the plasma display apparatus according to an embodiment of the present invention.
Figure 2B:
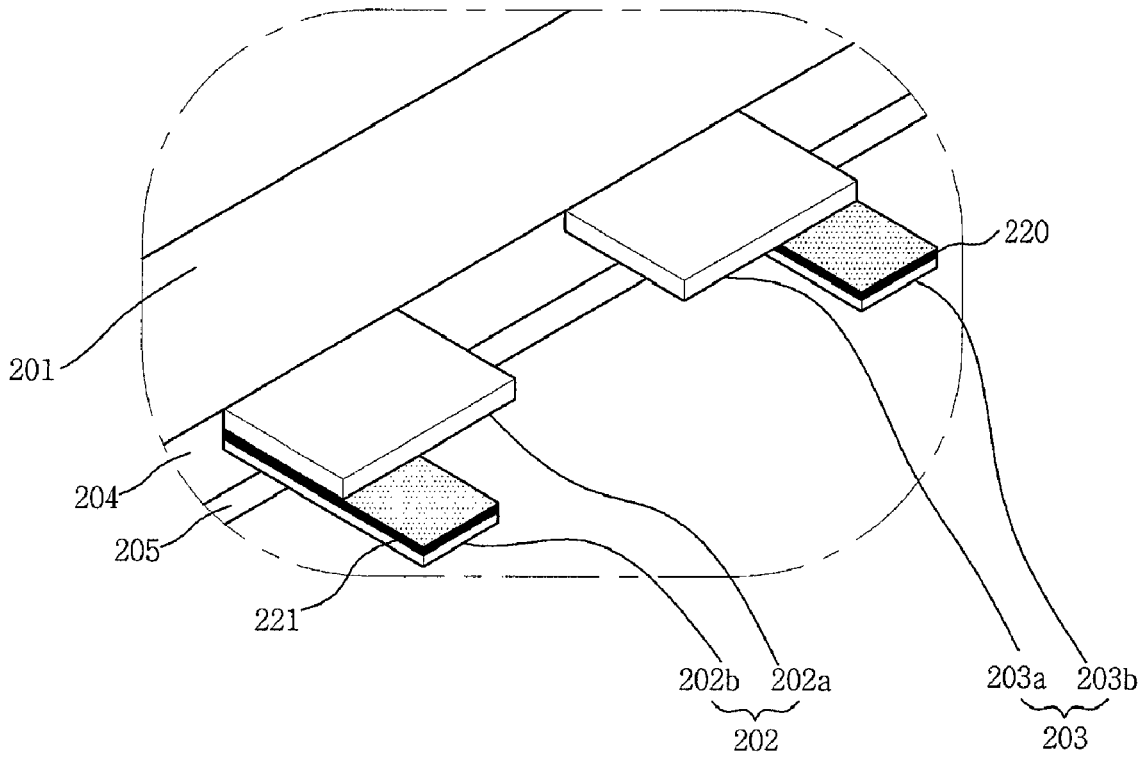

FIGS. 2*a* and 2*b* are views illustrating the construction of the plasma display panel comprised in the plasma display apparatus according to an embodiment of the present invention.

Referring first to FIG. 2*a*, the plasma display panel 100 comprises a front panel 200 comprising a front substrate 201 in which electrodes, that is, a first electrode 202 and a second electrode 203 parallel to each other are formed, and a rear panel 210 comprising a front substrate 211 in which third electrodes 213 crossing the first electrode 202 and the second electrode 203 are formed. The front panel 200 and the rear panel 210 may be coalesced together.

The first electrode 202 and the second electrode 203 formed on the front substrate 201 can generate discharge in a discharge space, that is, a discharge cell, and can also sustain the discharge of the discharge cell.

A dielectric layer to cover the first electrode 202 and the second electrode 203, for example, an upper dielectric layer 204 can be formed on the front substrate 201 on which the first electrode 202 and the second electrode 203 are formed.

The upper dielectric layer 204 can limit the discharge currents of the first electrode 202 and the second electrode 203, and can provide insulation between the first electrode 202 and the second electrode 203.

On a top surface of the upper dielectric layer 204 can be formed a protection layer 205 for facilitating discharge conditions.

The protection layer 205 can be formed by a method of depositing Magnesium Oxide (MgO), etc. on the upper dielectric layer 204 or the like.

Meanwhile, the third electrodes 213 formed on the front substrate 211 are electrodes for applying a data signal to the discharge cell.

A dielectric layer to cover the third electrodes 213, for example, a lower dielectric layer 215 can be formed on a top surface of the front substrate 211 in which the third electrodes 213 are formed.

The lower dielectric layer 215 can insulate the third electrodes 213.

Barrier ribs 212 of a stripe type, a well type, a delta type, a beehive type or the like, for partitioning discharge spaces, that is, discharge cells can be formed on the lower dielectric layer 215.

Accordingly, discharge cells of red (R), green (G), blue (B) and so on can be formed between the front substrate 201 and the front substrate 211.

A specific discharge gas can be filled within each of the discharge cells partitioned by the barrier ribs 212.

A phosphor layer 214 that emits a visible ray for image display at the time of address discharge can also be formed within each of the discharge cells partitioned by the barrier ribs 212. For example, R, G, and B phosphor layers can be formed within the discharge cells.

In the above plasma display panel, if a driving signal is applied to at least one of the first electrode 202, the second electrode 203 and the third electrodes 213, discharge can be generated within the discharge cells partitioned by the barrier ribs 212.

Then, vacuum ultraviolet rays are generated from the discharge gas filled within the discharge cell. The vacuum ultraviolet rays are applied to the phosphor layers 214 formed within the discharge cells. Thus, a visible ray is generated from each phosphor layer 214. The generated visible ray is discharged externally through the front substrate 201 in which the upper dielectric layer 204 is formed, so that an image can be displayed on an exterior surface of the front substrate 201.

Meanwhile, it has been shown in FIG. 2*a* that each of the first electrode 202 and the second electrode 203 has only one layer. However, one or more of the first electrode 202 and the second electrode 203 can have a plurality of layers. This example is described below with reference to FIG. 2*b*.

Referring to FIG. 2*b*, each of the first electrode 202 and the second electrode 203 can have two layers.

In particular, in view of external discharge of light generated within the discharge cells and securing driving efficiency in consideration of optical transmittance and electrical conductivity, the first electrode 202 and the second electrode 203 can comprise bus electrodes 202*b* and 203*b* made of opaque silver (Ag) material, and transparent electrodes 202*a* and 203*a* made of transparent Indium Tin Oxide (ITO) material.

The reason why the first electrode 202 and the second electrode 203 comprise the transparent electrodes 202*a* and 203*a*, respectively, as described above is that a visible ray generated within the discharge cells can be effectively discharged outside the plasma display panel.

Further, the reason why the first electrode 202 and the second electrode 203 comprise the bus electrodes 202*b* and 203*b*, respectively, is as follows. In the case where the first electrode 202 and the second electrode 203 comprise only the transparent electrodes 202*a* and 203*a*, respectively, electrical conductivity of the transparent electrodes 202*a* and 203*a* is relatively low and driving efficiency can be decreased accordingly. However, such low electrical conductivity of the transparent electrodes 202*a* and 203*a*, which may cause a decrease in driving efficiency, can be compensated for by the bus electrodes 202*b* and 203*b*.

In the case where the first electrode 202 and the second electrode 203 comprise the bus electrodes 202*b* and 203*b*, respectively, as described above, black layers 220 and 221 may be further provided between the transparent electrode 202*a* and the bus electrode 202*b*, and between the transparent electrode 203*a* and the bus electrode 203*b*, respectively, in order to prevent reflection of external light by the bus electrodes 202*b* and 203*b*.

Meanwhile, in the construction shown in FIG. 2*b*, the transparent electrodes 202*a* and 203*a* may be omitted. In other words, an ITO-less construction is possible.

For example, the first electrode 202 and the second electrode 203 may comprise only the bus electrodes 202*b* and 203*b* without the transparent electrodes 202*a* and 203*a* in FIG. 2*b*. In other words, the first electrode 202 and the second electrode 203 may comprise one layer of the bus electrodes 202*b* and 203*b*.

In FIGS. 2*a* and 2*b*, only an example of the plasma display panel of the present invention has been shown and described. It is, however, to be understood that the present invention is not limited to the plasma display panel having the construction as shown in FIGS. 2*a* and 2*b*.

For example, in the plasma display panel shown in FIGS. 2*a* and 2*b*, it has been described that each of the upper dielectric layer 204 and the lower dielectric layer 215 has only one layer. However, at least one of the upper dielectric layer 204 and the lower dielectric layer 215 may have a plurality of layers.

Further, in order to prevent reflection of external light due to the barrier ribs 212, a black layer (not shown), which can absorb external light, may be further formed on the barrier ribs 212.

As described above, the construction of the plasma display panel applied to the plasma display apparatus according to an embodiment of the present invention may be changed in various ways.

An exemplary operation of the plasma display apparatus comprising the plasma display panel according to an embodiment of the present invention is described below with reference to FIGS. 3 and 4.

Figure 3:
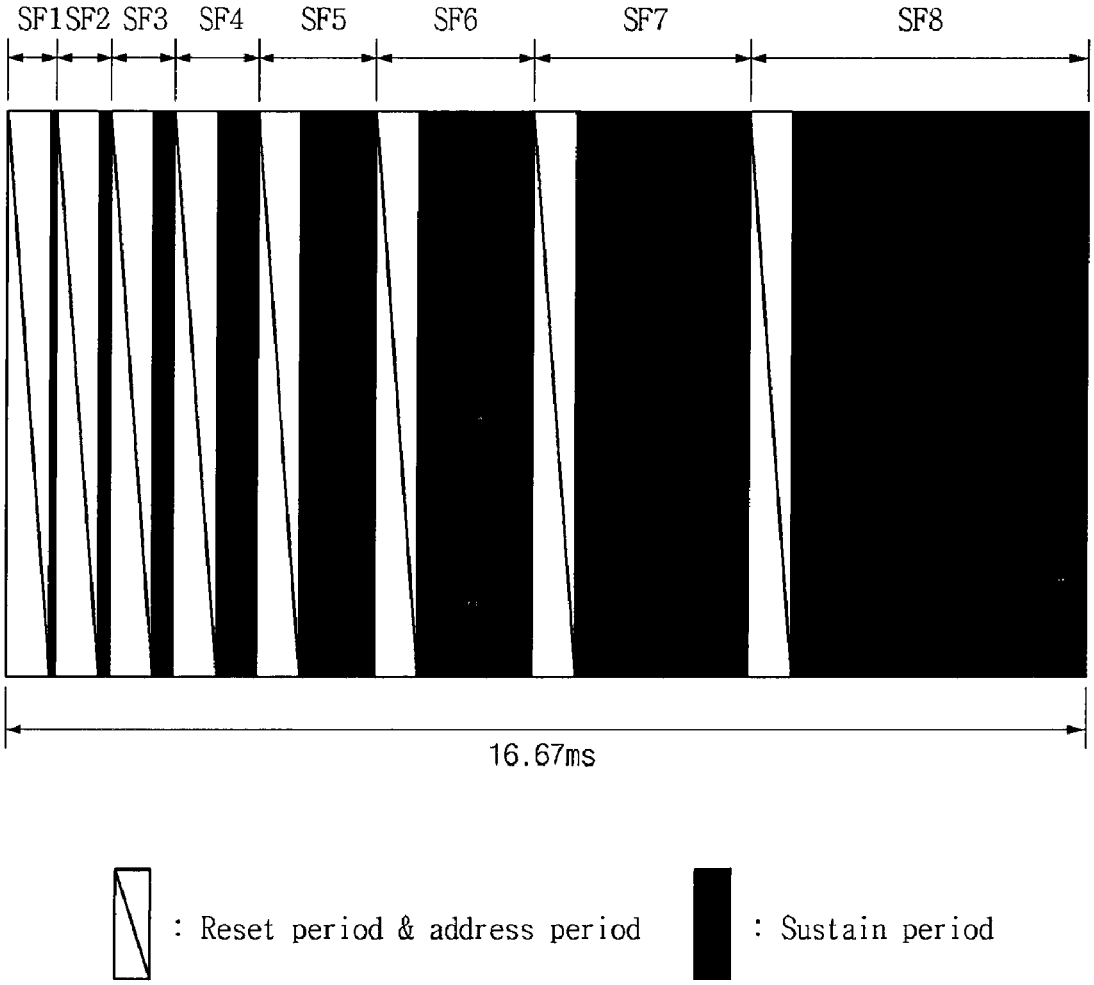
FIG. 3 is a view illustrating a frame for implementing gray levels of an image in the plasma display apparatus according to an embodiment of the present invention.

FIG. 3 is a view illustrating a frame for implementing gray levels of an image in the plasma display apparatus according to an embodiment of the present invention.

Figure 4:
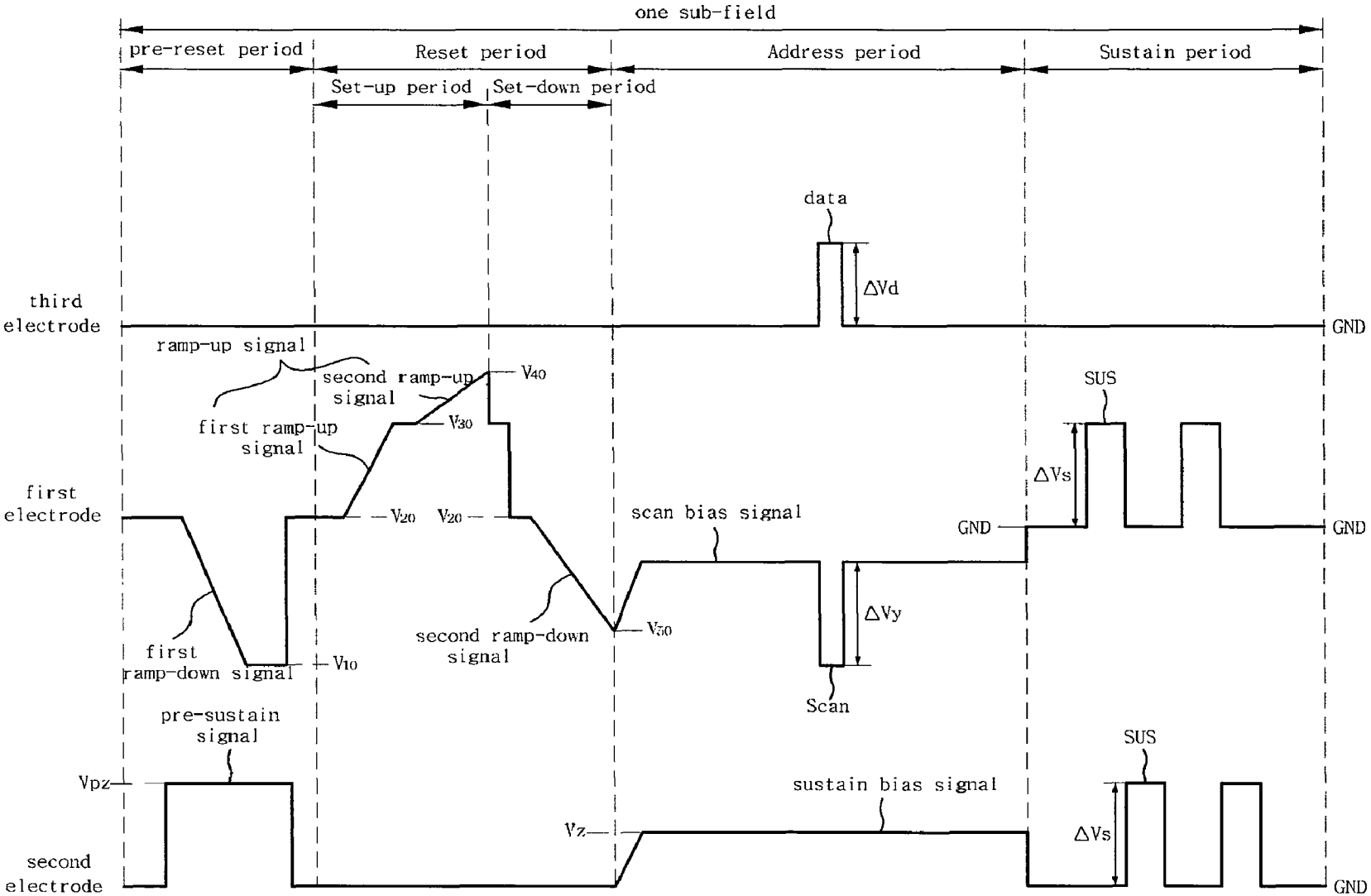
FIG. 4 is a view illustrating the operation of the plasma display apparatus according to an embodiment of the present invention.

Further, FIG. 4 is a view illustrating the operation of the plasma display apparatus according to an embodiment of the present invention.

Referring to FIG. 3, in the plasma display apparatus according to an embodiment of the present invention, a frame for implementing gray levels of an image is divided into several subfields having a different number of emissions.

Further, although not shown in the drawing, each subfield can be divided into a reset period for resetting the entire discharge cells, an address period for selecting a discharge cell to be discharged, and a sustain period for implementing gray levels depending on the number of discharges.

For example, if it is sought to display an image with 256 gray levels, a frame period (16.67 ms) corresponding to 1/60 seconds is divided into eight subfields SF1 to SF8, and each of the eight subfields SF1 to SF8 is divided into a reset period, an address period and a sustain period, as shown in FIG. 3.

Meanwhile, a gray level weight of a corresponding subfield can be set by controlling the number of sustain signals supplied in the sustain period. In other words, a specific gray level weight may be assigned to each subfield by employing the sustain period.

For example, a gray level weight of each subfield can be decided such that it increases in the ratio of 2n (where, n=0, 1, 2, 3, 4, 5, 6, 7) in such a manner that a gray level weight of a first subfield is set to 20 and a gray level weight of a second subfield is set to 21.

Gray levels of various images can be implemented by controlling the number of sustain signals supplied in the sustain period of each subfield depending on a gray level weight in each subfield as described above.

The plasma display apparatus according to an embodiment of the present invention uses a plurality of frames in order to display an image of 1 second. For example, 60 frames are used to display an image of 1 second.

It has been shown in FIG. 3 that one frame comprises eight subfields. It is however to be understood that the number of subfields constituting one frame may be changed in various ways.

For example, 12 subfields from a first subfield to a twelfth subfield may form one frame, 10 subfields may form one frame or the like.

The picture quality of an image implemented by the plasma display apparatus that implement gray levels of an image using the frame may be decided depending on the number of subfields comprised in the frame. In other words, when the number of subfields comprised in a frame is 12, gray levels of an image of 212 kinds can be represented. When the number of subfields comprised in a frame is 8, gray levels of an image of 28 kinds can be represented.

It has been shown in FIG. 3 that the subfields are arranged in order of increasing gray level weights in one frame. However, the subfields can be arranged in order of decreasing gray level weights in one frame, or can be arranged regardless of gray level weights.

Referring to FIG. 4, there is shown the operation of the plasma display apparatus in any one of the plurality of subfields comprised in the frame as shown in FIG. 3 according to an embodiment of the present invention.

The driver 110 shown in FIG. 1 may apply a first ramp-down signal to the first electrode in a pre-reset period anterior to the reset period.

The driver 110 may apply a pre-sustain signal having an opposite polarity to that of the first ramp-down signal to the second electrode while the first ramp-down signal is applied to the first electrode.

The first ramp-down signal applied to the first electrode may gradually fall up to a tenth voltage V10. The first ramp-down signal may gradually fall from a voltage of a ground level GND.

The pre-sustain signal may maintain a pre-sustain voltage Vpz substantially constantly. The pre-sustain voltage Vpz may be substantially the same voltage as a voltage of a sustain signal SUS applied in the subsequent sustain period, that is, a sustain voltage Vs.

If the first ramp-down signal is applied to the first electrode and the pre-sustain signal is applied to the second electrode in the pre-reset period as described above, wall charges having a specific polarity are accumulated on the first electrode, and wall charges having an opposite polarity to that of the first electrode are accumulated on the second electrode. For example, positive (+) wall charges may be accumulated on the first electrode and negative (−) wall charges may be accumulated on the second electrode.

Accordingly, in the subsequent reset period, a sufficient intensity of set-up discharge can be generated, and as a result, resetting can be performed sufficiently stably.

Further, even when the amount of wall charges is short within the discharge cell, a sufficient intensity of set-up discharge can be generated.

Although a voltage of the ramp-up signal applied to the first electrode in the reset period is low, a sufficient intensity of set-up discharge can be generated.

The above-described pre-reset period may be comprised anterior to the reset period in the whole subfields of the frame.

Alternatively, from the viewpoint of a driving time, the pre-reset period may be comprised anterior to the reset period in one of subfields of a frame, which has the smallest gray level weight, or the pre-reset period may be comprised anterior to the reset period in two or three of subfields of a frame.

Alternatively, the pre-reset period may be omitted in the whole subfields.

After the pre-reset period, in a set-up period of the reset period for resetting, the driver 110 may apply a ramp-up signal having an opposite polarity to that of the first ramp-down signal to the first electrode.

The ramp-up signal may comprise a first ramp-up signal gradually rising from a twentieth voltage V20 to a thirtieth voltage V30 with a first slope, and a second ramp-up signal gradually rising from the thirtieth voltage V30 to a fortieth voltage V40 with a second slope.

In the set-up period, weak dark discharge, that is, set-up discharge is generated within the discharge cell by means of the ramp-up signal. The set-up discharge causes some degree of wall charges to be accumulated within the discharge cell.

The second slope of the second ramp-up signal may be smoother than the first slope. If the second slope is smoother than the first slope as described above, voltage can rise relatively rapidly before the set-up discharge is generated, and voltage can rise relatively slowly while the set-up discharge is generated. Accordingly, the amount of light generated by the set-up discharge can be decreased.

It is therefore possible to improve contrast characteristics.

In a set-down period posterior to the set-up period, the driver 110 may apply a second ramp-down signal having an opposite polarity to that of the ramp-up signal to the first electrode after the ramp-up signal.

The second ramp-down signal may gradually fall from the twentieth voltage V20 to a fiftieth voltage V50.

Accordingly, weak ease discharge, that is, set-down discharge is generated within the discharge cell. The set-down discharge causes wall charges of the degree that address discharge can be generated stably to uniformly remain within the discharge cell.

Meanwhile, the ramp-up signal or the second ramp-down signal may be set differently from that of FIG. 4. This example is described below with reference to FIGS. 5*a* and 5*b*, FIGS. 5*a* and 5*b* are views illustrating another forms of the ramp-up signal or the second ramp-down signal.

Figure 5A:
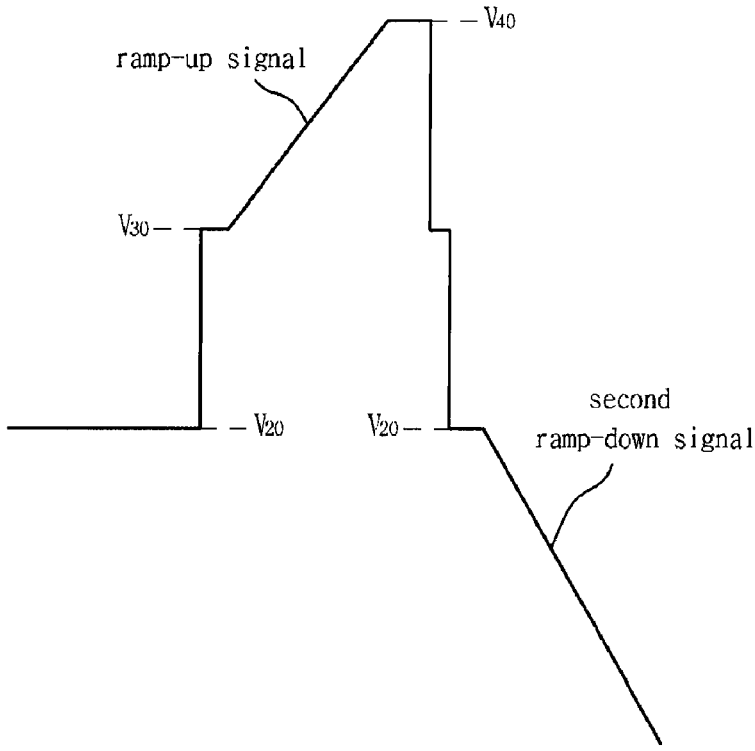
FIGS. 5*a* and 5*b* are views illustrating another forms of a ramp-up signal or a second ramp-down signal.

Referring to FIG. 5*a*, a ramp-up signal abruptly rises up to a thirtieth voltage V30 and then gradually rises from the thirtieth voltage V30 to a fortieth voltage V40.

As described above, the ramp-up signal may be changed in various ways, such as that the ramp-up signal gradually rises with different slopes in two steps as in FIG. 4 and the ramp-up signal gradually rises in one step as in FIG. 5*a*.

Figure 5B:
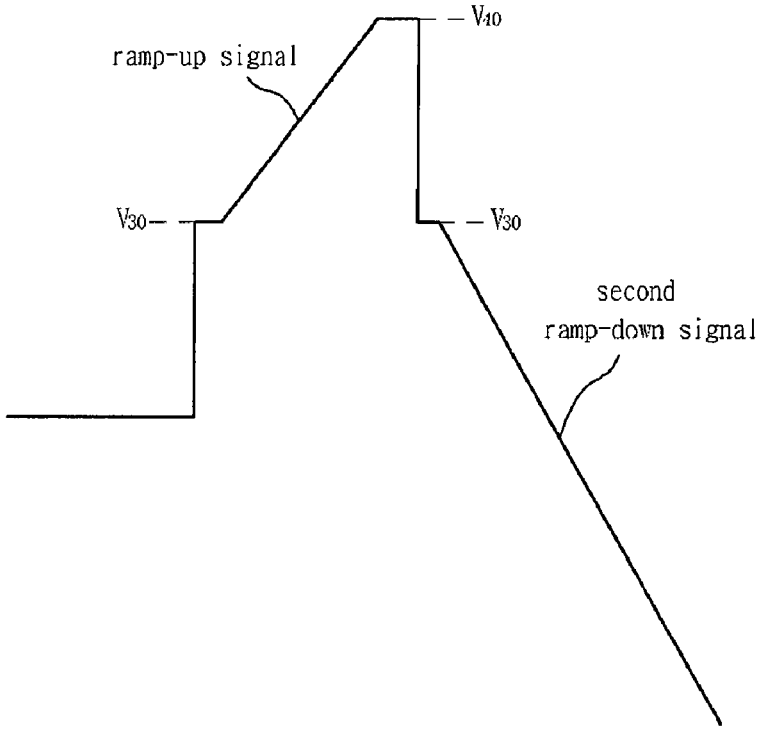

Referring to FIG. 5*b*, a voltage of a second ramp-down signal gradually falls from a thirtieth voltage V30.

As described above, a point of time at which a voltage of the second ramp-down signal falls may be changed in various ways, such as that a point of time at which a voltage of the second ramp-down signal falls is set differently.

Description about FIGS. 5*a* and 5*b* is thereby completed.

Meanwhile, in the address period posterior to the reset period, the driver 110 may apply a scan bias signal whose voltage substantially keeps higher than the fiftieth voltage V50 of the second ramp-down signal to the first electrode.

A scan signal Scan that falls from the scan bias signal as much as a scan voltage Δvy may be applied to the entire first electrodes Y1 to Yn.

For example, a first scan signal Scan 1 may be applied to a first electrode Y1 of the plurality of first electrodes, a second scan signal Scan 2 may be applied to a second first electrode Y2 of the plurality of first electrodes, and a $n^{th}$ scan signal Scan n may be applied to a $n^{th}$ first electrode Yn of the plurality of first electrodes.

When the scan signal Scan is applied to the first electrode as described above, a data signal that rises as much as a data voltage ΔVd can be applied to the third electrode.

As the scan signal Scan and the data signal data are applied, address discharge is generated within a discharge cell to which the data voltage ΔVd of the data signal is applied as a difference between the scan voltage Δvy of the scan signal Scan and the data voltage ΔVd of the data signal and a wall voltage by wall charges generated in the reset period are added.

Wall charges of the degree that sustain discharge can be generated when the sustain signal SUS is applied in the subsequent sustain period are formed within a discharge cell selected by the address discharge.

In this case, the driver 110 may apply a sustain bias signal to the second electrode in the address period in order to prevent the address discharge from becoming unstable due to the interference of the second electrode.

The sustain bias signal can substantially constantly sustain a sustain bias voltage Vz, which is lower than the voltage of the sustain signal applied in the sustain period, but higher than the voltage of the ground level GND.

Thereafter, the driver 110 may apply the sustain signal SUS to one or more of the first electrode and the second electrode in the sustain period for image display. For example, the driver 110 can alternately apply the sustain signal SUS to the first electrode and the second electrode. The sustain signal SUS can have the amount of voltage as much as ΔVs.

If the sustain signal SUS is applied, sustain discharge, that is, display discharge is generated between the first electrode and the second electrode of the discharge selected by the address discharge whenever the sustain signal SUS is applied as a wall voltage within the discharge cell and the sustain voltage ΔVs of the sustain signal SUS are added. Accordingly, an image can be implemented on the plasma display panel.

In this case, the sustain signal applied to the first electrode and the second electrode in the sustain period is described in more detail below.

Figure 6A:
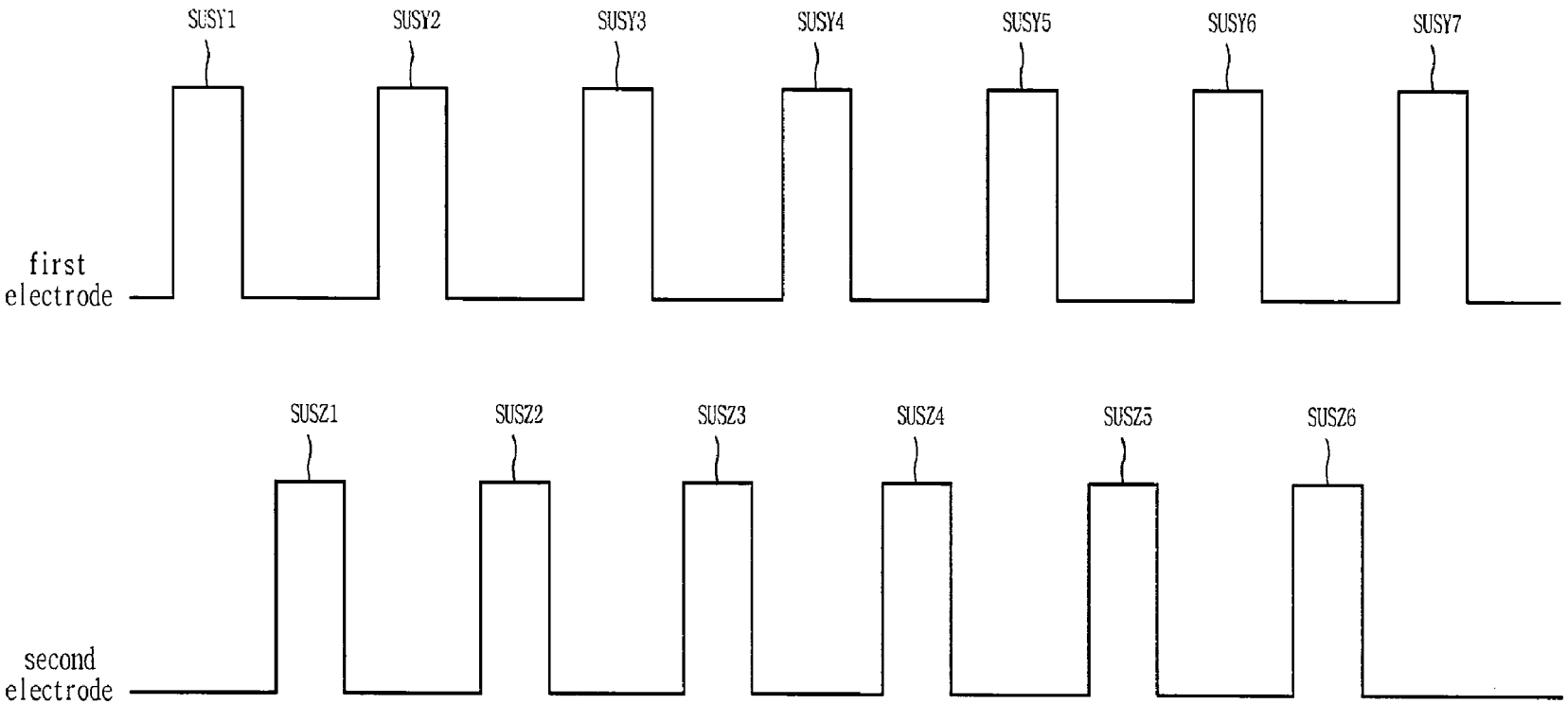
FIGS. 6*a* to 6*c* are views illustrating, in more detail, a sustain signal applied to a first electrode and a second electrode in a sustain period.
Figure 6B:
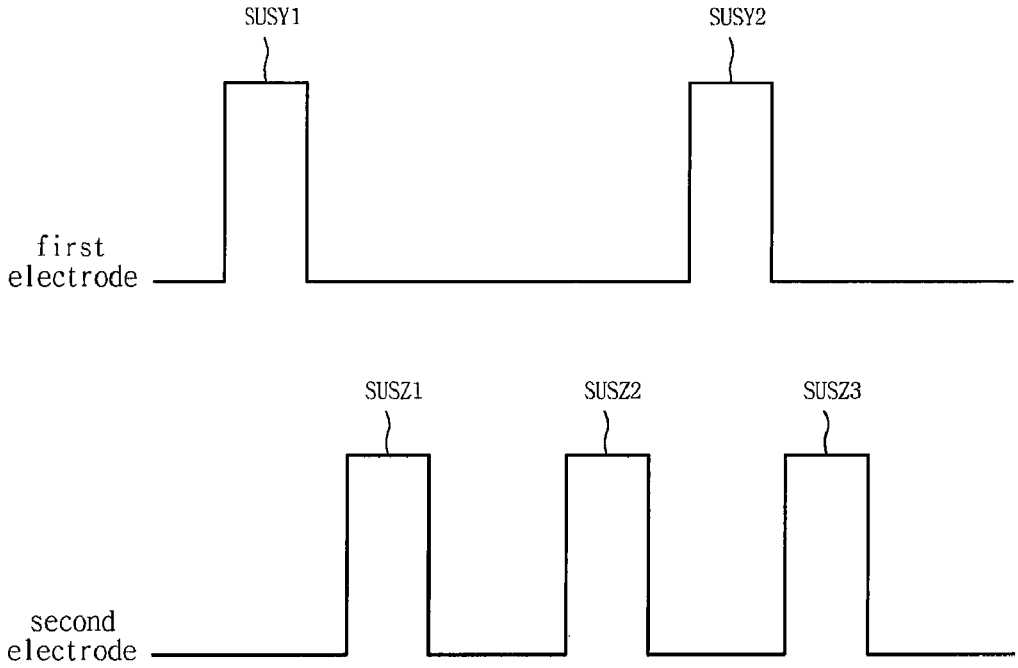
Figure 6C:
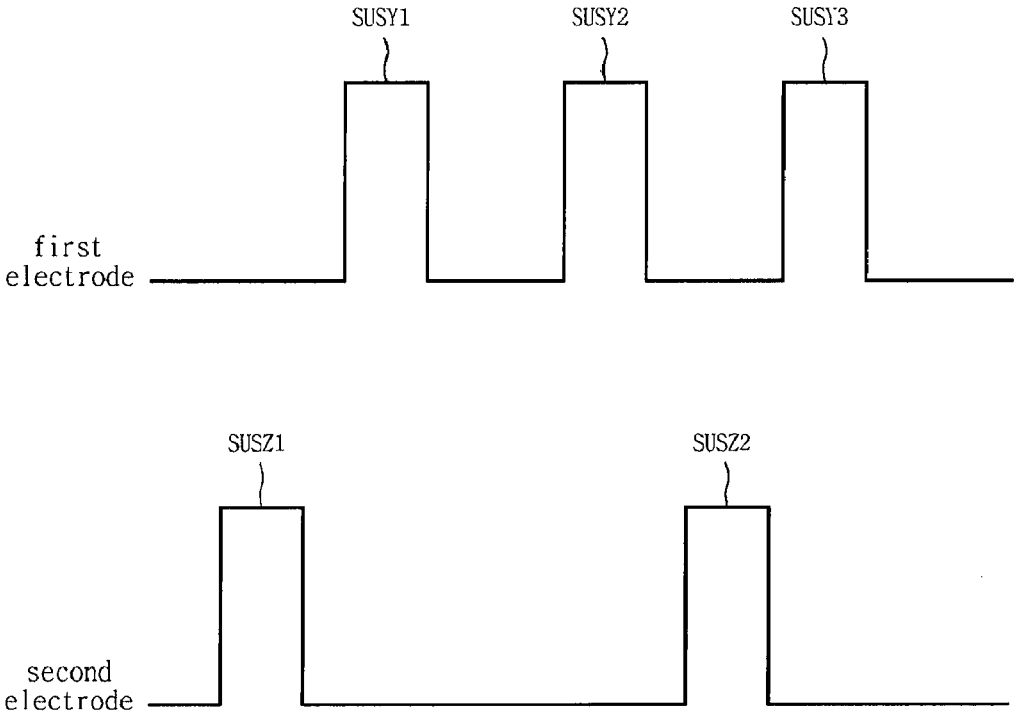

FIGS. 6*a* to 6*c* are views illustrating, in more detail, the sustain signal applied to the first electrode and the second electrode in the sustain period.

Referring to FIG. 6*a*, the number of sustain signals applied to the first electrode and the number of sustain signals applied to the second electrode are different from each other.

For example, the number of the sustain signals applied to the first electrode can be 7 from 1 to 7, and the number of the sustain signals applied to the second electrode can be 6 from 1 to 6.

It has been shown in FIG. 6*a* that the number of the sustain signals applied to the first electrode is greater than the number of the sustain signals applied to the second electrode. However, the number of the sustain signals applied to the first electrode can be smaller than or the same as the number of the sustain signals applied to the second electrode.

As described above, a method of making different the number of the sustain signals applied to the first electrode and the number of the sustain signals applied to the second electrode may be changed in various ways.

As shown in FIG. 6*b*, the number of sustain signals applied to the first electrode can be set different from the number of sustain signals applied to the second electrode in such a manner that two or more sustain signals SUSZ1 and SUSZ2 are consecutively applied to the second electrode while two consecutive sustain signals SUSY1 and SUSY2 are applied to the first electrode.

In other words, the sustain signal SUSZ1 and the sustain signal SUSZ2 can be consecutively applied to the second electrode before the sustain signal SUSY2 is applied to the first electrode since the sustain signal SUSY1 is applied to the first electrode.

This corresponds to a case where the number of the sustain signals applied to the second electrode is greater than the number of the sustain signals applied to the first electrode. The two sustain signals applied to the first electrode, that is, the sustain signal SUSY1 and the sustain signal SUSY2 are neighboring sustain signals.

Further, a distance from when the sustain signal SUSY1 is applied to the first electrode to when the sustain signal SUSY2 is applied to the first electrode can be 1.5 to 5 times that from when the sustain signal SUSZ1 is applied to the second electrode to when the sustain signal SUSZ2 is applied to the second electrode.

The reason why the distance from when the sustain signal SUSY1 is applied to the first electrode to when the sustain signal SUSY2 is applied to the first electrode is 5 times smaller than that from when the sustain signal SUSZ1 is applied to the second electrode to when the sustain signal SUSZ2 is applied to the second electrode is as follows. As a duration time of a specific mode increases, the distributions of wall charges can be further adhered. In this case, the occurrence of an afterimage can be prohibited to the greatest extent possible by shaking the adhesion of wall charges. Furthermore, the reason why the distance from when the sustain signal SUSY1 is applied to the first electrode to when the sustain signal SUSY2 is applied to the first electrode is 1.5 times greater than that from when the sustain signal SUSZ1 is applied to the second electrode to when the sustain signal SUSZ2 is applied to the second electrode is that it can prevent a decrease in a luminance characteristic while prohibiting the occurrence of an afterimage.

Alternatively, as illustrated in FIG. 6*c*, the number of sustain signals applied to the first electrode and the number of sustain signals applied to the second electrode can be set differently in such a manner that any sustain signals are not applied to the second electrode while two sustain signals SUSY1 and SUSY2, which are adjacent and consecutive to each other, to the first electrode.

That is, any sustain signals are not applied to the second electrode in a period from when the sustain signal SUSY1 is applied to the first electrode to when the sustain signal SUSY2 is applied to the first electrode.

In other words, the sustain signal SUSY1 and the sustain signal SUSY2 are continuously applied to the first electrode in a period from when the sustain signal SUSY1 is applied to the second electrode to when the sustain signal SUSY2 is applied to the second electrode.

This corresponds to a case where the number of sustain signals applied to the first electrode is greater than the number of sustain signals applied to the second electrode.

In this case, a distance from when the sustain signal SUSY1 is applied to the second electrode to when the sustain signal SUSY2 is applied to the second electrode can be 1.5 to 5 times that from when the sustain signal SUSZ1 is applied to the first electrode to when the sustain signal SUSZ2 is applied to the first electrode.

The reason why the from when the sustain signal SUSY1 is applied to the second electrode to when the sustain signal SUSY2 is applied to the second electrode is 5 times smaller than that from when the sustain signal SUSZ1 is applied to the first electrode to when the sustain signal SUSZ2 is applied to the first electrode is as follows. As a duration time of a specific mode increases, the distributions of wall charges can be further adhered. In this case, the occurrence of an afterimage can be prohibited to the greatest extent possible by shaking the adhesion of wall charges. Furthermore, the reason why the from when the sustain signal SUSY1 is applied to the second electrode to when the sustain signal SUSY2 is applied to the second electrode is 1.5 times greater than that from when the sustain signal SUSZ1 is applied to the first electrode to when the sustain signal SUSZ2 is applied to the first electrode is that it can prevent a decrease in a luminance characteristic while prohibiting the occurrence of an afterimage.

Meanwhile, a more detailed method of making different the number of sustain signals applied to the first electrode and the number of sustain signals applied to the second electrode as described above is described below with reference to FIGS. 7*a* and 7*b*.

Figure 7A:
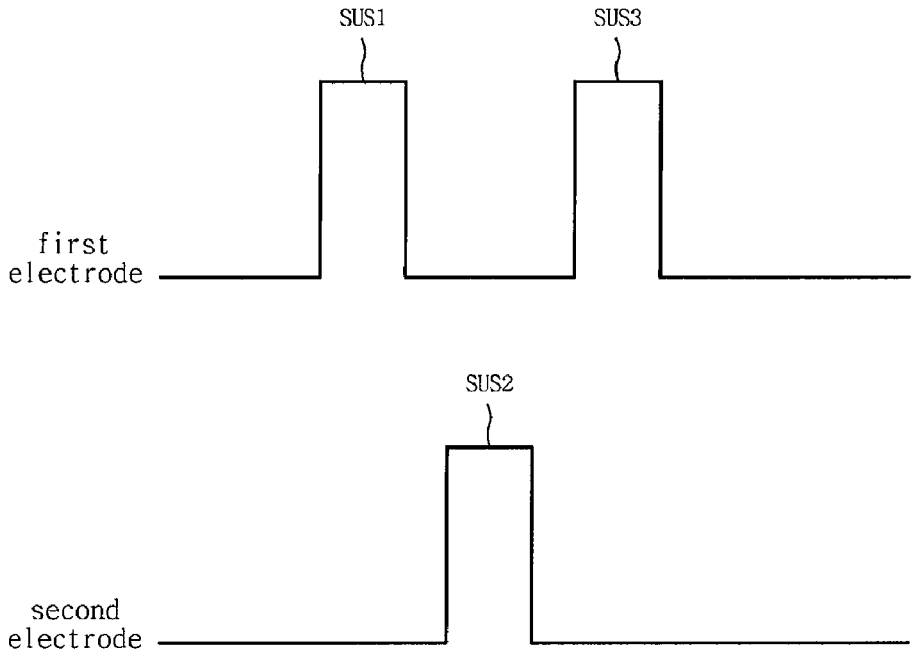
FIGS. 7*a* and 7*b* are views illustrating, in more detail, a method of making different the number of sustain signals applied to the first electrode and the number of sustain signals applied to the second electrode.
Figure 7A:
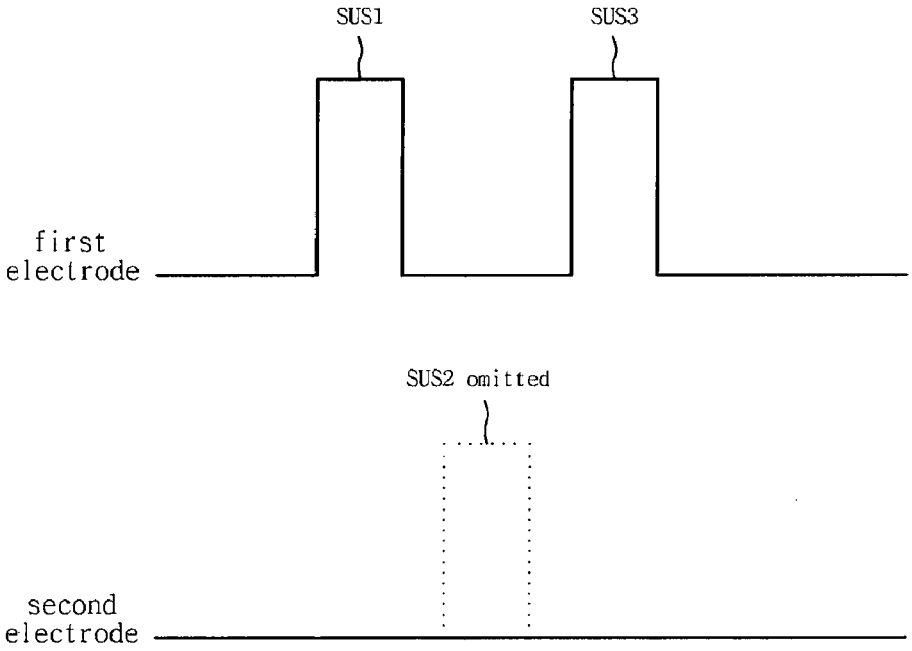
Figure 7B:
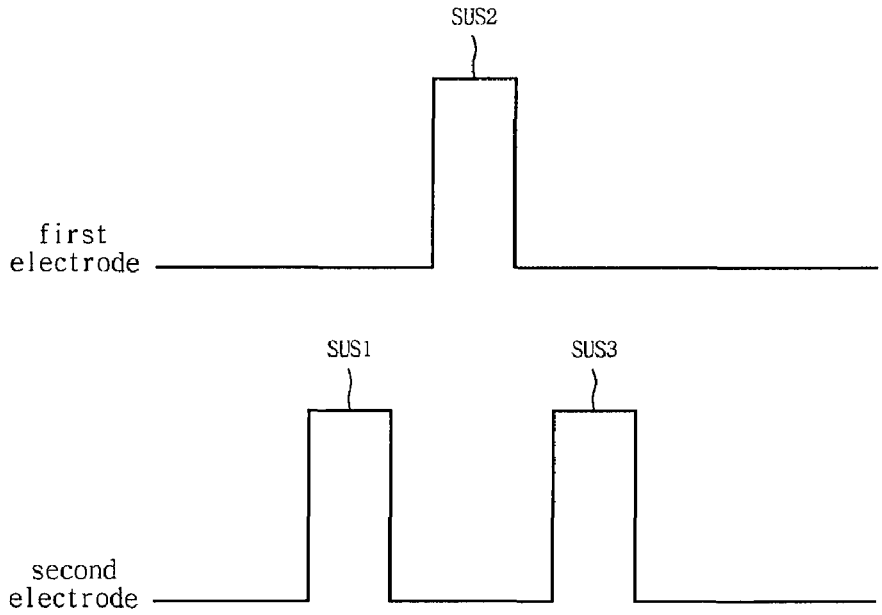
Figure 7B:
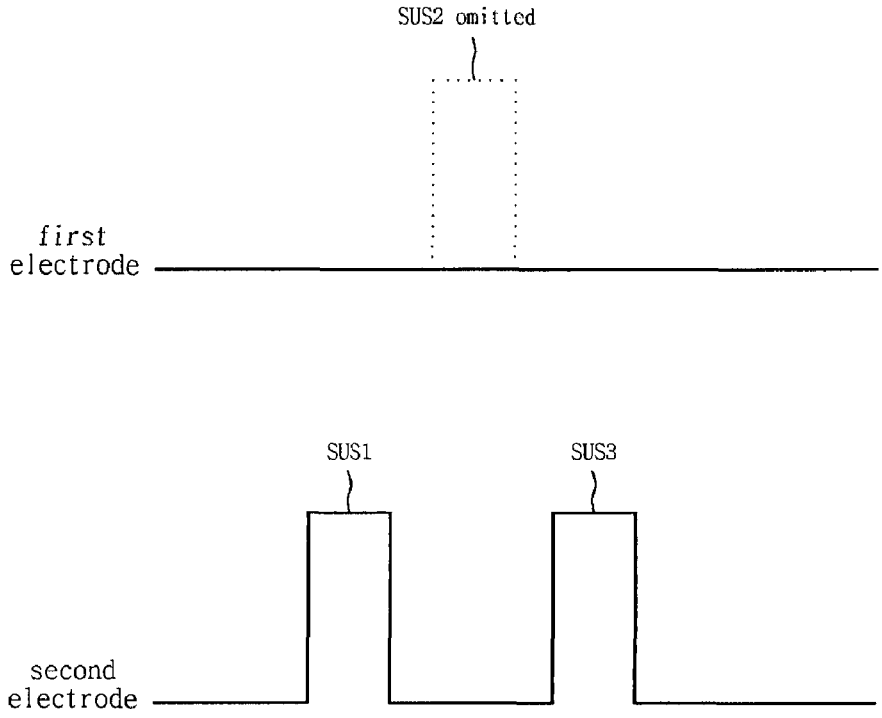

FIGS. 7*a* and 7*b* are views illustrating, in more detail, a method of making different the number of sustain signals applied to the first electrode and the number of sustain signals applied to the second electrode.

FIG. 7*a* illustrates an example in which the number of sustain signals applied to the first electrode is greater than the number of sustain signals applied to the second electrode, as in FIG. 6*c*.

For example, it is assumed that a first sustain signal SUS1 is first applied to the first electrode, a second sustain signal SUS2 is applied to the second electrode, and a third sustain signal SUS3 is then applied to the first electrode in the sustain period, as in (a) of FIG. 7*a*.

In this case, in order to set the number of sustain signals applied to the first electrode to be greater than the number of sustain signals applied to the second electrode as in FIG. 6*c*, the third sustain signal SUS3 can be applied to the first electrode in a state where the second sustain signal SUS2 to be applied to the second electrode is omitted after the first sustain signal SUS1 is applied to the first electrode in the sustain period as in (b) of FIG. 7*a*.

In other words, the number of the sustain signals applied to the first electrode can be increased by omitting the second sustain signal SUS2 to be applied to the second electrode.

FIG. 7*b* illustrates an example in which the number of sustain signals applied to the second electrode is greater than the number of sustain signals applied to the first electrode, as in FIG. 6*b*.

For example, it is assumed that a first sustain signal SUS1 is first applied to the second electrode, a second sustain signal SUS2 is applied to the first electrode, and a third sustain signal SUS3 is then applied to the second electrode in the sustain period, as in (a) of FIG. 7*b*.

In this case, in order to make the number of sustain signals applied to the second electrode greater than the number of sustain signals applied to the first electrode as in FIG. 6*b*, the third sustain signal SUS3 can be applied to the second electrode in a state where the second sustain signal SUS2 to be applied to the first electrode is omitted after the first sustain signal SUS1 is applied to the second electrode in the sustain period as in (b) of FIG. 7*b*.

In other words, the number of the sustain signals applied to the second electrode can be increased by omitting the second sustain signal SUS2 to be applied to the first electrode.

If the number of sustain signals applied to the first electrode is set different from the number of sustain signals applied to the second electrode as described above, the occurrence of an afterimage can be decreased. This is described below with reference to FIGS. 8*a* and 8*b*.

Figure 8A:
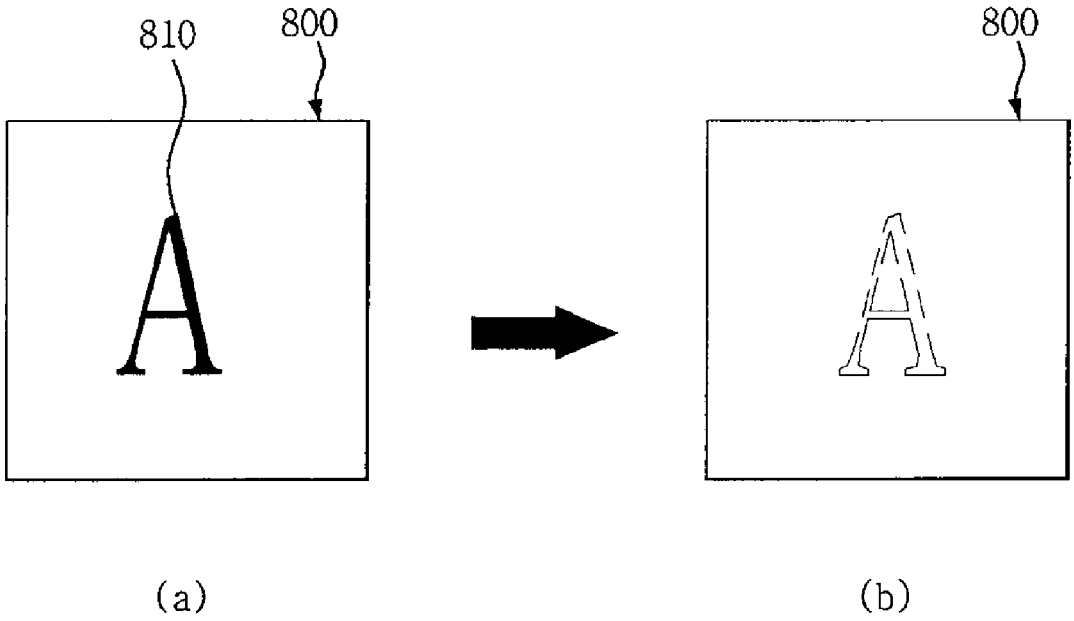
FIGS. 8*a* and 8*b* are views illustrating a reason why the number of sustain signals applied to the first electrode is made different from the number of sustain signals applied to the second electrode.
Figure 8B:
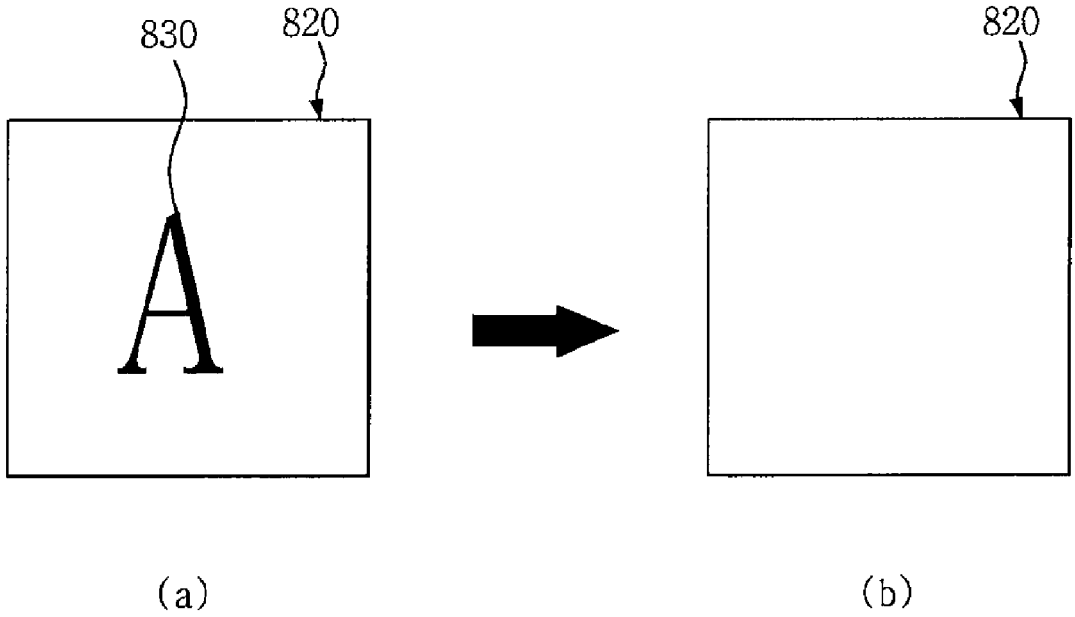

FIGS. 8*a* and 8*b* are views illustrating a reason why the number of sustain signals applied to the first electrode is set different from the number of sustain signals applied to the second electrode.

FIG. 8*a* illustrates an example in which the same number of sustain signals are applied to the first electrode and the second electrode.

For instance, it is assumed that an image 810, such as "A", is displayed on a screen 800 as shown in (a) of FIG. 8*a*.

If the same number of sustain signals are applied to the first electrode and the second electrode, an afterimage in which the image "A", which had been displayed previously, remains faintly occurs although the image 810 of "A" displayed on the screen 800 is turned off, as shown in (b) of FIG. 8*a*. Accordingly, the picture quality of an image implemented is degraded.

FIG. 8*b* illustrates an example in which the number of sustain signals applied to the first electrode is different from the number of sustain signals applied to the second electrode.

For instance, it is assumed that an image 813, such as "A", is displayed on a screen 820 as shown in (a) of FIG. 8*b*. In this case, it is assumed that after the first sustain signal SUS1 is applied to the first electrode, the third sustain signal SUS3 is applied to the first electrode without applying the second sustain signal SUS2 to the second electrode, as shown in (b) of FIG. 7*a*.

In this case, after sustain discharge is generated by the first sustain signal applied to the first electrode, the second sustain signal to be applied to the second electrode is omitted. Thus, distributions of wall charges within a discharge cell that can be easily adhered are shaken.

Accordingly, when the image 830 of "A" displayed on the screen 820 is turned off, the image of "A" that had been displayed previously is clearly removed without being left, as shown in (b) of FIG. 8*a*. That is, the occurrence of an afterimage can be prevented.

Meanwhile, a method of making different the number of sustain signals applied to the first electrode and the number of sustain signals applied to the second electrode can be applied in a specific mode.

That is, the number of sustain signals applied to the first electrode is set to be the same as the number of sustain signals applied to the second electrode in a common mode, whereas the number of sustain signals applied to the first electrode is set different from the number of sustain signals applied to the second electrode in a specific mode.

The specific mode may be a mode sensitive to an afterimage. In other words, a mode having conditions in which the afterimage can occur easily can be set to the specific mode.

Thus, the specific mode may be a mode in which substantially the same image is displayed on a specific cell for a critical time or more. The cell can also be interpreted as a specific region on the screen. Alternatively, the specific mode may be a mode in which an image having substantially the same APL is displayed on a specific cell for a critical time or more.

To help understanding of the present invention, the APL and an example of the specific mode are described below with reference to FIGS. 9, 10*a* and 10*b*.

Figure 9:
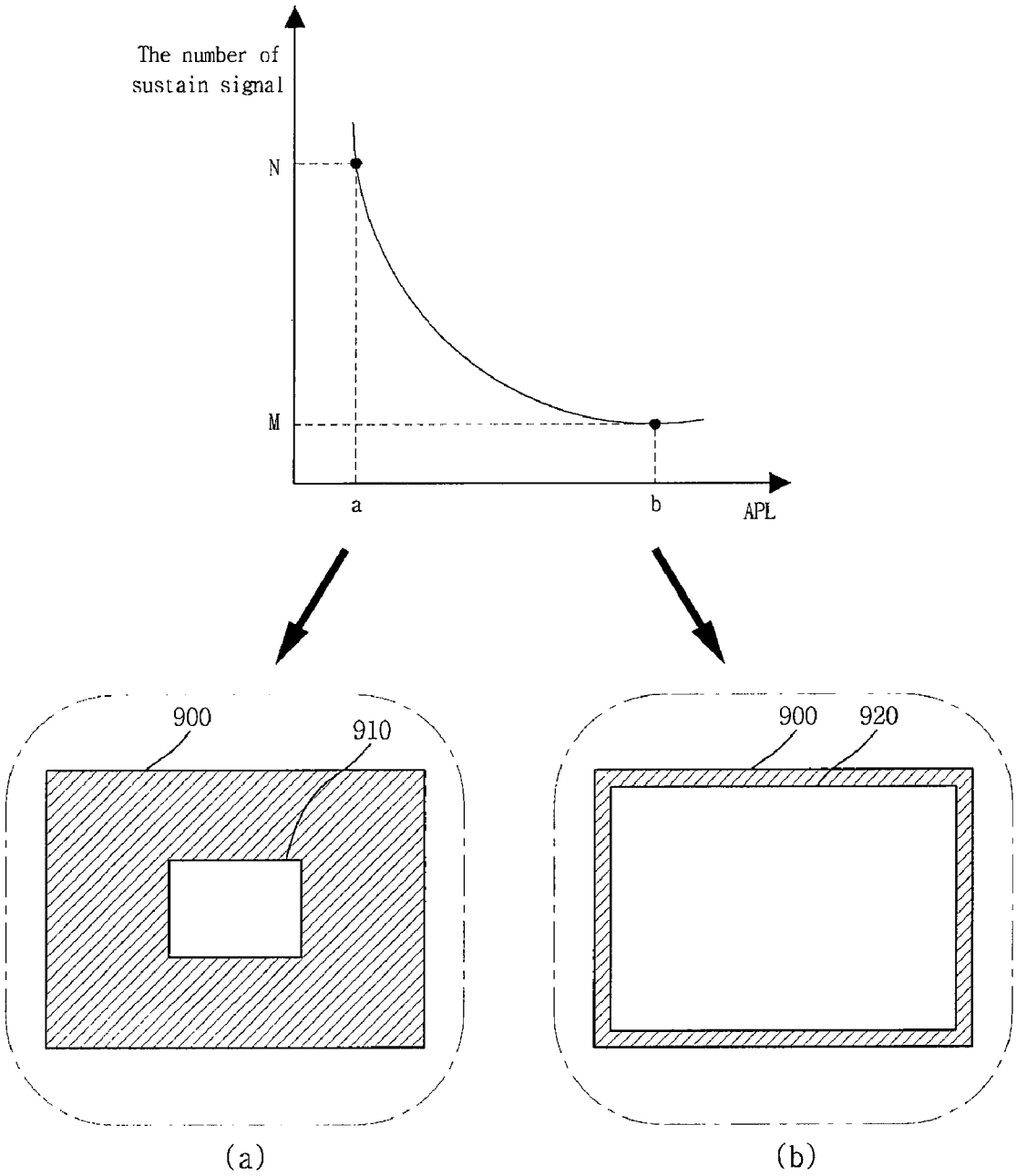
FIG. 9 is a view illustrating, in more detail, an average power level (APL)

FIG. 9 is a view illustrating, in more detail, the APL.

Figure 10A:
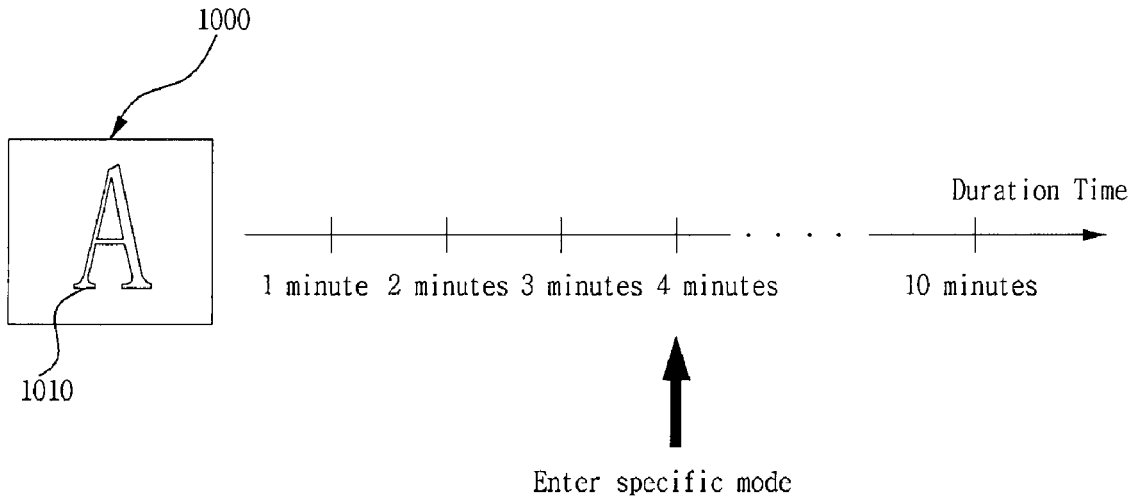
FIGS. 10*a* and 10*b* are views illustrating, in more detail, an example of a specific mode.
Figure 10B:
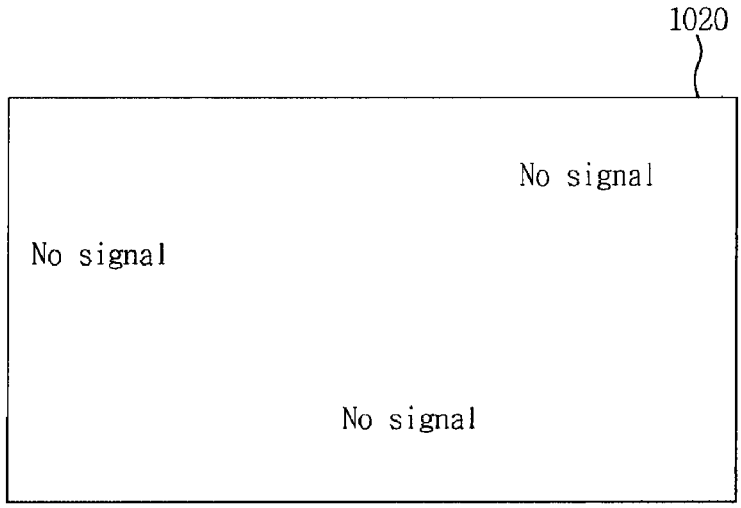

Further, FIGS. 10*a* and 10*b* are views illustrating, in more detail, an example of the specific mode.

Referring to FIG. 9, the APL is decided depending on the number of discharge cells, which are turned on, of discharge cells of a plasma display panel 900. In other words, the APL is decided depending on an area on which an image is displayed on the plasma display panel 900.

As the value of the APL increases, the number of sustain signals per gray level decreases, and as the value of the APL decreases, the number of sustain signals per gray level increases.

For example, in the case where an area 920 on which an image is displayed on the screen of the plasma display panel 900 is relatively large as shown in (b) of FIG. 9, that is, when the number of discharge cells that are turned on, of a plurality of discharge cells formed in the plasma display panel 900 is relatively large (this corresponds to a case where the APL is relatively large), the whole power consumption can be reduced by making relatively small the number of sustain signals per gray level, which are supplied to each discharge cell contributing to image display because the number of discharge cells contributing to image display is relatively large.

In contrast, in the case where an area 910 on which an image is displayed on the screen of the plasma display panel 900 is relatively small as shown in (a) of FIG. 9, that is, when the number of discharge cells that are turned on, of a plurality of discharge cells formed in the plasma display panel 900 is relatively small (this corresponds to a case where the APL is relatively small), the number of sustain signals per gray level, which are supplied to each discharge cell contributing to image display, is made relatively large since the number of discharge cells contributing to image display is relatively small.

Thus, by increasing the luminance of a portion on which an image is displayed, an abrupt increase of the whole power consumption can be prevented while increasing the whole luminance.

For example, as illustrated in FIG. 9, when the APL is in a level "a", the number of sustain signals per gray level accordingly can be N.

Further, when the APL is in a level "b" higher than the level "a", the number of sustain signals per gray level accordingly can be M smaller than N.

The specific mode can be set depending on the APL.

FIGS. 10*a* and 10*b* illustrate examples of a specific afterimage mode.

For example, in the case where an image 1010 of "A" is displayed on a plasma display panel 1000 as illustrated in FIG. 10*a*, a mode can be set to a specific mode in which the number of sustain signals applied to the first electrode and the number of sustain signals applied to the second electrode are set differently depending on a duration time at which the image 1010 is displayed.

For instance, the specific mode may start beginning a point of time at which the image 1010 of "A" continues on the plasma display panel 1000 for a critical time, for example, 4 minutes.

In other words, the specific mode may correspond to a case where the same image is displayed on a specific cell for a critical time or more, that is, a case where substantially the same image is continuously displayed on the plasma display panel 1000 for a critical time or more.

Alternatively, the mode can be set to the specific mode in the case where an image having substantially the same APL, as described in FIG. 9, is displayed for a critical time or more.

That is, considering that it is difficult to determine that substantially the same image is displayed and it is difficult that completely the same image is continuously displayed, whether to enter the specific mode can be determined in consideration of the APL as described with reference to FIG. 9.

In the case where time at which the image having substantially the same APL is continuously displayed is excessively short, there is a high possibility that a distribution characteristic of wall charges may not be adhered within a discharge cell. In the case where time at which the image having substantially the same APL is continuously displayed is excessively long, there is an increasing possibility that an afterimage may occur because a distribution characteristic of wall charges is excessively adhered within a discharge cell.

When considering the above, a critical time at which the image having substantially the same APL is continuously displayed may be set to range from approximately 30 seconds to 10 minutes.

FIG. 10*b* illustrates another method of setting the specific mode.

In more detail, a no-signal mode can also be set to a specific mode in which the number of sustain signals applied to the first electrode is set different from the number of sustain signals applied to the second electrode. This is described below.

For example, in the case where an image signal is not input from the outside, that is, there is no image signal, only On Screen Display (OSD) indicating "no signal" can be displayed on the screen.

A case where the OSD indicating "no signal" is continuously displayed on the screen at the time of no signal in which an image signal is not input as described above, for example, for a critical time or more is substantially the same as a case where an image having substantially the same APL is displayed for a critical time.

Thus, the OSD at the time of no signal can also generate an afterimage in the same manner as the above. Accordingly, at the time of no signal, the number of sustain signals applied to the first electrode can be set different from the number of sustain signals applied to the second electrode as in the present invention.

In the case where the number of sustain signals applied to the first electrode is set different from the number of sustain signals applied to the second electrode at the time of a specific mode as described above, a difference between the number of sustain signals applied to the first electrode and the number of sustain signals applied to the second electrode can be set differently by taking the duration time of the specific mode into consideration.

This is descried below with reference to FIG. 11.

Figure 11:
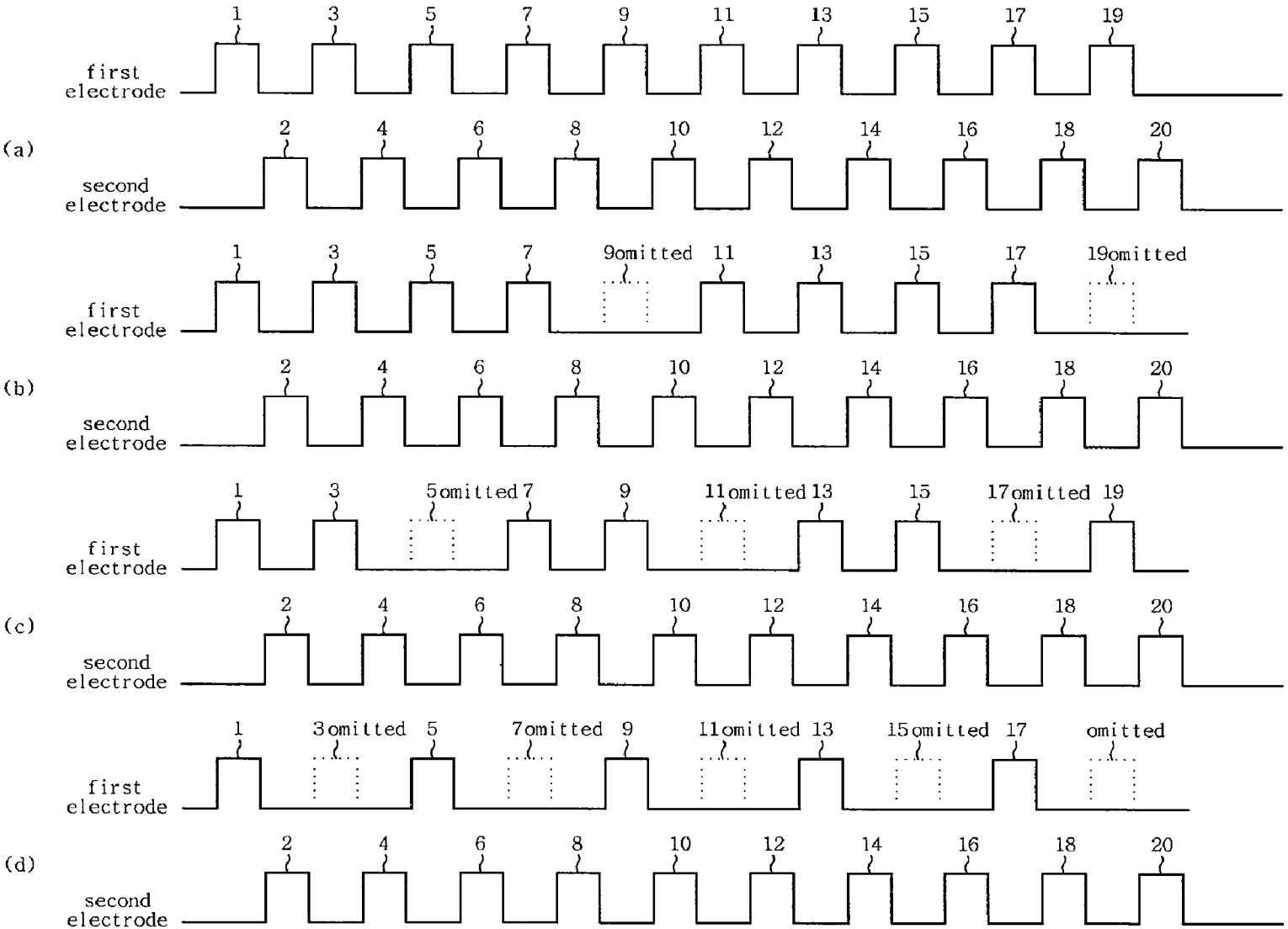
FIG. 11 is a view illustrating an exemplary method of controlling the number of sustain signals depending on a duration time of a specific mode.

FIG. 11 is a view illustrating an exemplary method of controlling the number of sustain signals depending on the duration time of the specific mode.

As illustrated in FIG. 11, it is assumed that a total of 20 sustain signals from a 1 sustain signal to a 20 sustain signal are sequentially applied in the sustain period.

It is also assumed that 1, 3, 5, 7, 9, 11, 13, 15, 17 and 19 sustain signals are applied to the first electrode and 2, 4, 6, 8, 10, 12, 14, 16, 18 and 20 sustain signals are applied to the second electrode in a common mode, as shown in (a) of FIG. 11.

In this case, if a specific mode is entered, the 9 sustain signal and the 19 sustain signal applied to the first electrode can be omitted as shown in (b) of FIG. 11.

In other words, in the case where the specific mode as shown in (b) is entered, two of the 20 sustain signals can be omitted compared with the common mode as shown in (a).

Thereafter, in the case where the specific mode continues and, therefore, the duration time of the specific mode is a first critical time, for example, 4 minutes or more, the 5 sustain signal, the 11 sustain signal and the 17 sustain signal applied to the first electrode can be omitted as shown in (c) of FIG. 11.

In other words, in the case where the duration time of the specific mode is the first critical time, for example, 4 minutes or more as shown in (c), three of the 20 sustain signals can be omitted compared with the case where the specific mode is entered as shown in (b).

Thereafter, in the case where the specific mode continues and, therefore, the duration time of the specific mode is a second critical time, for example, 8 minutes or more, the 3 sustain signal, the 7 sustain signal, the 11 sustain signal, the 15 sustain signal and the 19 sustain signal applied to the first electrode can be omitted as shown in (d) of FIG. 11.

In other words, in the case where the duration time of the specific mode is the second critical time, for example, 8 minutes or more as shown in (d), five of the 20 sustain signals can be omitted compared with the case where the duration time of the specific mode is the first critical time, for example, 4 minutes or more as shown in (c).

In other words, the number of sustain signals, which are omitted as the duration time of the specific mode increases, is increased. This is because if the duration time of the specific mode increases, the distributions of wall charges within a discharge cell are further adhered and, as a result, the occurrence of an afterimage can be further increased.

Meanwhile, it has been described above that only the sustain signals applied to either the first electrode or the second electrode are omitted. It is however to be noted that one or more of sustain signals applied to the first electrode and one or more of sustain signals applied to the second electrode can be omitted together. An example of which is described below.

Figure 12:
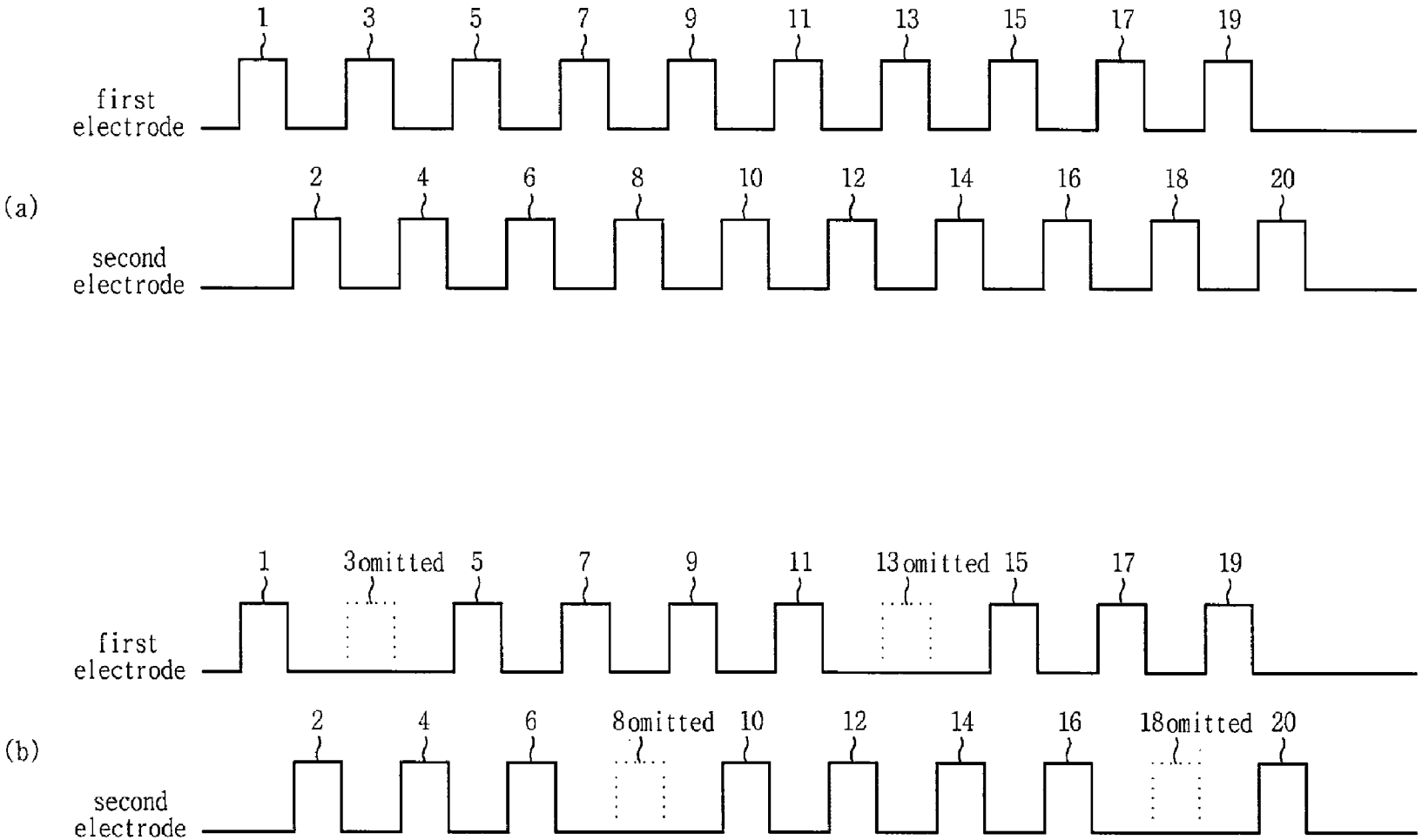
FIG. 12 is a view illustrating an exemplary method of omitting one or more of sustain signals applied to the first electrode and one or more of sustain signals applied to the second electrode at the same time.

FIG. 12 is a view illustrating an exemplary method of omitting one or more of sustain signals applied to the first electrode and one or more of sustain signals applied to the second electrode at the same time.

As illustrated in FIG. 12, it is assumed that a total of 20 sustain signals from a 1 sustain signal to a 20 sustain signal are sequentially applied in the sustain period.

It is also assumed that 1, 3, 5, 7, 9, 11, 13, 15, 17 and 19 sustain signals are applied to the first electrode and 2, 4, 6, 8, 10, 12, 14, 16, 18 and 20 sustain signals are applied to the second electrode in a common mode, as shown in (a) of FIG. 12.

In this state, if the specific mode is entered, the 3 sustain signal and the 13 sustain signal applied to the first electrode, and the 8 sustain signal and the 18 sustain signal applied to the second electrode can be omitted together, as shown in (b) of FIG. 12.

In other words, in the case where the specific mode is entered as in (b), two of the 10 sustain signals applied to the first electrode and two of the 10 sustain signals applied to the second electrode can be omitted at the same time compared with the common mode as shown in (a).

The example of FIG. 12 can be applied to a case that is further sensitive to an afterimage.

Figure 13:
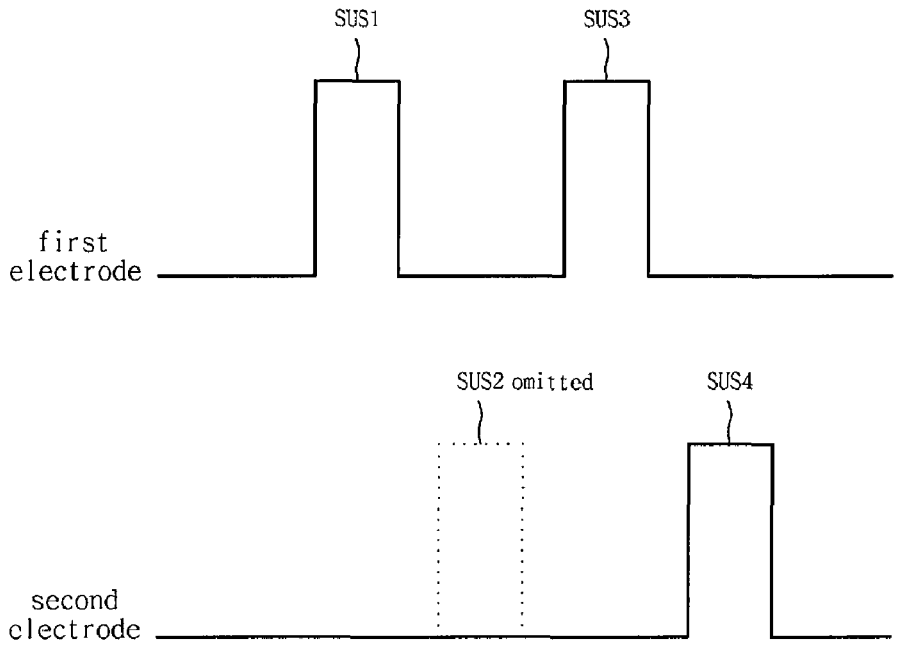
FIG. 13 is a view illustrating continuous omission of two or more sustain signals.
Figure 13:
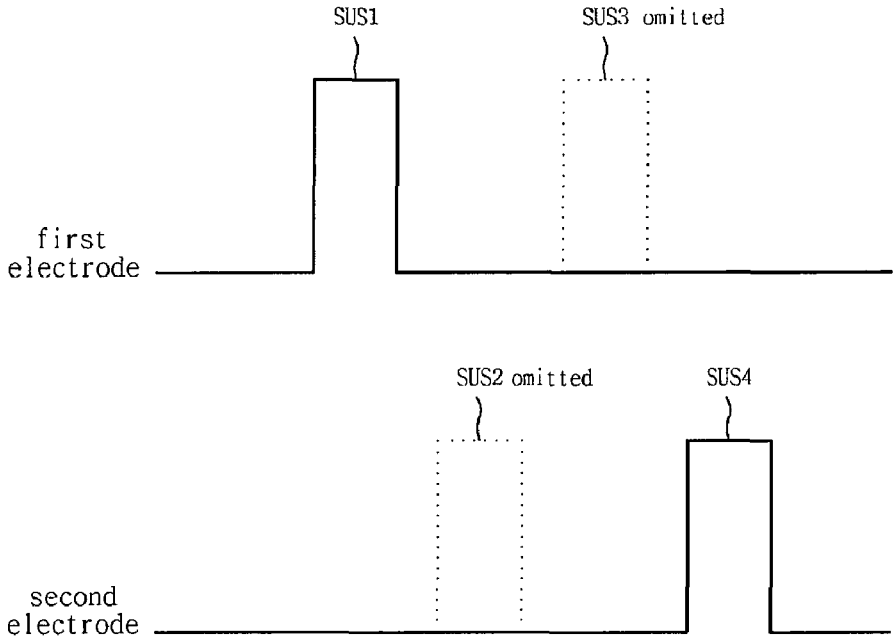

FIG. 13 is a view illustrating continuous omission of two or more sustain signals.

In the specific mode, after a first sustain signal SUS1 is applied to the first electrode, a second sustain signal SUS2 to be applied to the second electrode can be omitted, and after a third sustain signal SUS3 is applied to the first electrode, a fourth sustain signal SUS4 can be applied to the second electrode, as shown in (a) of FIG. 13.

In other words, after one sustain signal to be applied to the second electrode is omitted, a next sustain signal can be applied to the first electrode different from the second electrode.

In contrast, in the specific mode, after the first sustain signal SUS1 is applied to the first electrode, the second sustain signal SUS2 and the third sustain signal SUS3 are omitted, and the fourth sustain signal SUS4 can be then applied to the second electrode, as shown in (b) of FIG. 13.

In other words, after one sustain signal to be applied to the second electrode is omitted and one sustain signal to be applied to the first electrode is consecutively omitted, a next sustain signal is applied to the second electrode.

As described above, the omitted sustain signals can be selected in various ways.

It has been described above that the number of sustain signals that are consecutively omitted is 2. It is however to be noted that the number of sustain signals that are consecutively omitted can be changed in various ways, such as 3, 4 and 5.

Meanwhile, it has been described above that the sustain signal is alternately applied to the first electrode and the second electrode. It is, however, to be understood that the sustain signal may be applied to only either the first electrode or the second electrode, an example of which is described below.

Figure 14:
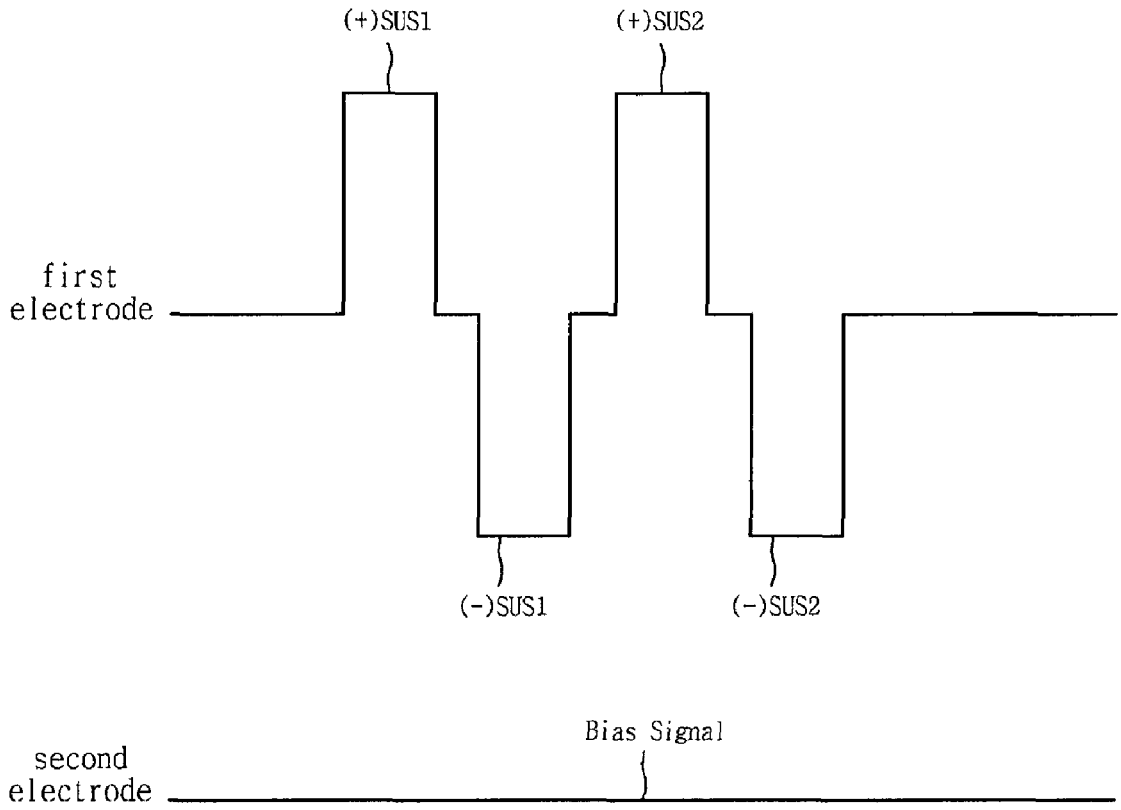
FIG. 14 is a view illustrating another type of a sustain signal.

FIG. 14 is a view illustrating another type of the sustain signal.

Referring to FIG. 14, a positive sustain signal and a negative sustain signal are alternately applied to one of the first electrode and the second electrode, for example, the first electrode. For example, a first positive sustain signal +SUS1 can be applied to the first electrode, a first negative sustain signal −SUS1 can be applied to the same first electrode, a second positive sustain signal +SUS2 can be applied to the same first electrode, and a second negative sustain signal −SUS2 can be then applied to the same first electrode.

While the positive sustain signal and the negative sustain signal are applied to one electrode as described above, a bias signal can be applied to the other electrode.

The bias signal may maintain the voltage of the ground level GND substantially constantly.

As described above, the form of the sustain signal SUS can be changed variously.

If the sustain signal is applied to one of the first electrode and the second electrode and the bias signal is applied to the other of the first electrode and the second electrode in the sustain period as described above, the shape of the driver can be further simplified.

For example, in the case where the sustain signal is applied to the first electrode and the sustain signal is also applied to the second electrode, a driving board in which circuits for applying the sustain signal to the first electrode are disposed and a driving board in which circuits for applying the sustain signal to the second electrode are disposed are respectively required.

In contrast, in the case where the sustain signal is applied to either the first electrode or the second electrode as illustrated in FIG. 14, only one driving board in which circuits for applying the sustain signal to either the first electrode or the second electrode are disposed can be used.

Accordingly, an overall size of the driver can be reduced and the manufacturing cost can be saved accordingly.

Even in the case where the sustain signal is applied to only one of the first electrode and the second electrode as shown in FIG. 14, the occurrence of an afterimage can be reduced by omitting one or more of a plurality of sustain signals, an example of which is described below.

Figure 15:
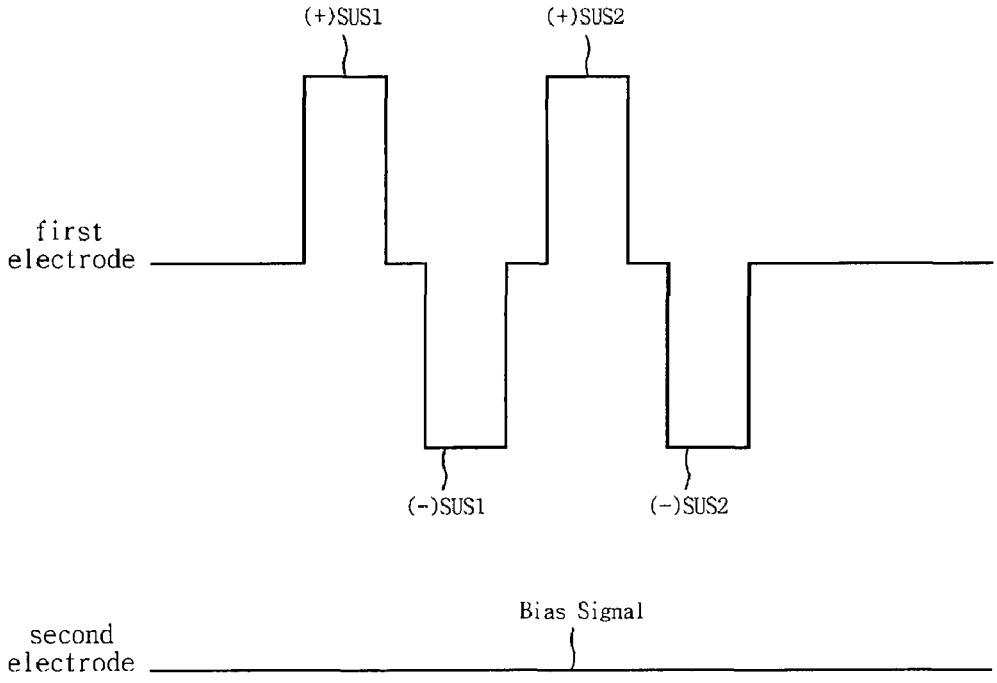
FIG. 15 is a view illustrating an exemplary method of reducing the occurrence of an afterimage in the case of FIG. 14.
Figure 15:
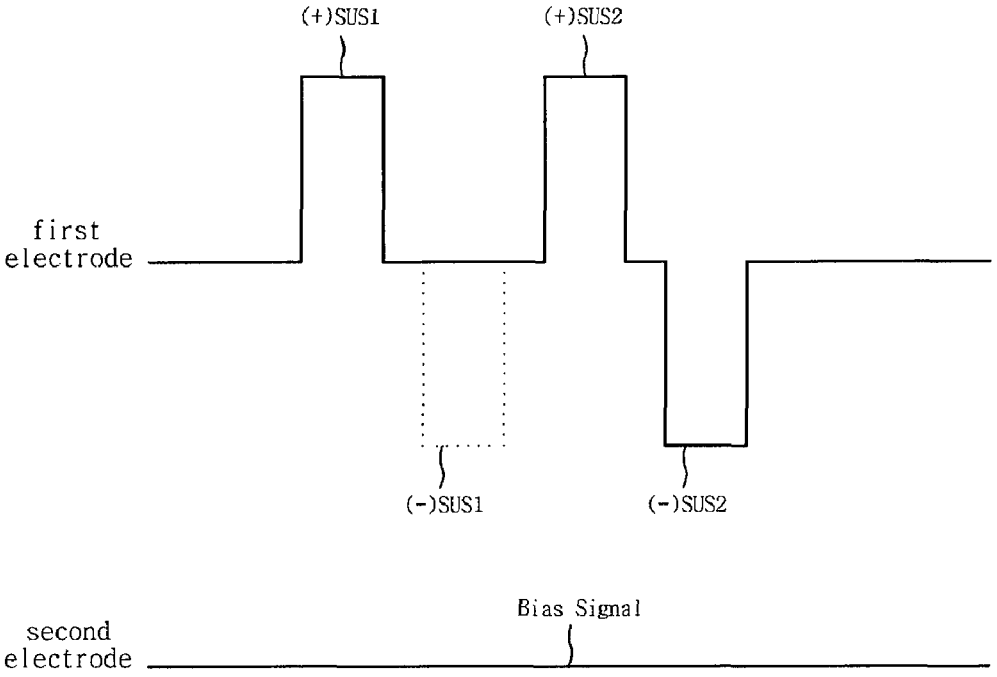

FIG. 15 is a view illustrating an exemplary method of reducing the occurrence of an afterimage in the case of FIG. 14.

As illustrated in (a) of FIG. 15, in the common mode, first and second positive sustain signals +SUS1 and +SUS2 and first and second negative sustain signals −SUS1 and −SUS2 can be applied to the first electrode.

As illustrated in (b) of FIG. 15, in the specific mode in which an afterimage may occur, for example, the first positive sustain signal +SUS1 can be applied to the first electrode, the first negative sustain signal −SUS1 to be applied to the same first electrode can be omitted, the second positive sustain signal +SUS2 can be applied to the same first electrode, and the second negative sustain signal −SUS2 can be then applied to the same first electrode.

As described above, the plasma display apparatus according to an embodiment of the present invention is advantageous in that it can prevent the occurrence of an afterimage.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A plasma display apparatus, comprising:

a plasma display panel comprising a first electrode and a second electrode, the plasma display panel being configured to measure a first time interval during which a substantially same image is displayed by the plasma display panel for a plurality of frames; and a driver configured to apply two or more sustain signals to the second electrode in a period during which two consecutive sustain signals are applied to the first electrode in a sustain period included in a frame disposed subsequently to the plurality of frames when the first time interval exceeds a critical time interval, and apply a single sustain signal to the second electrode in a period during which the two consecutive sustain signals to the first electrode in the sustain period included in the frame disposed subsequently to the plurality of frames when the first time interval does not exceed the critical time interval, wherein a waveform of each sustain signal applied to the first electrode in the sustain period is substantially identical to a waveform of each sustain signal applied to the second electrode in the sustain period, wherein a number of the sustain signals applied to the first electrode in the sustain period is less than a number of the sustain signals applied to the second electrode in the sustain period when the first time interval exceeds the critical time interval, wherein the number of the sustain signals applied to the first electrode and the number of the sustain signals applied to the second electrode, in the sustain period, are equal to each other when the first time interval does not exceed the critical time interval, and wherein the critical time interval comprises a first critical time interval, a second critical time interval, and a third critical time interval, and the first critical time interval ranges from 30 seconds to 4 minutes, the second critical time interval ranges from 4 minutes to 8 minutes, and the third critical time interval ranges from 8 minutes to 10 minutes.

2. The plasma display apparatus of claim 1, wherein a difference between the number of the sustain signals applied to the first electrode and the number of the sustain signals applied to the second electrode, during the sustain period, is equal to 2 when the first time interval falls within a range of the first critical time interval.

3. The plasma display apparatus of claim 1, wherein a difference between the number of the sustain signals applied to the first electrode and the number of the sustain signals applied to the second electrode, during the sustain period, is equal to 3 when the first time interval falls within a range of the second critical time interval.

4. The plasma display apparatus of claim 1, wherein a difference between the number of the sustain signals applied to the first electrode and the number of the sustain signals applied to the second electrode, during the sustain period, is equal to 5 when the first time interval falls within a range of the third critical time interval.

5. A plasma display apparatus, comprising:

a plasma display panel comprising a first electrode and a second electrode, the plasma display panel being configured to measure a first time interval during which a substantially same image is displayed by the plasma display panel for a plurality of frames; and a driver configured to apply two or more sustain signals to the second electrode in a period during which two consecutive sustain signals are applied to the first electrode in a sustain period included in a frame disposed subsequently to the plurality of frames when the first time interval exceeds a critical time interval, and apply a single sustain signal to the second electrode in a period during which the two consecutive sustain signals to the first electrode in the sustain period included in the frame disposed subsequently to the plurality of frames when the first time interval does not exceed the critical time interval, wherein a waveform of each sustain signal applied to the first electrode in the sustain period is substantially identical to a waveform of each sustain signal applied to the second electrode in the sustain period, wherein a number of the sustain signals applied to the first electrode in the sustain period is less than a number of the sustain signals applied to the second electrode in the sustain period when the first time interval exceeds the critical time interval, wherein the number of the sustain signals applied to the first electrode and the number of the sustain signals applied to the second electrode, in the sustain period, are equal to each other when the first time interval does not exceed the critical time interval, and wherein the critical time interval comprises a first critical time interval, a second critical time interval, and a third critical time interval, a duration of the first critical time interval is shorter than a duration of the second critical time interval, and the duration of the second critical time interval is shorter than a duration of the third critical time interval, and a number of sustain signals applied to the first electrode and the second electrode during the first critical time interval is less than a number of sustain signals applied to the first electrode and the second electrode during the second critical time interval, and the number of sustain signals applied to the first electrode and the second electrode during the second critical time interval is less than a number of sustain signals applied to the first electrode and the second electrode during the third critical time interval.

* * * * *